US009373304B2

(12) United States Patent
Liu

(10) Patent No.: US 9,373,304 B2
(45) Date of Patent: Jun. 21, 2016

(54) DISPLAY CONTROL METHOD FOR ADJUSTING COLOR LIGHT SOURCE CORRESPONDING TO COLOR DATA

(71) Applicant: Hung-Ta Liu, Hsinchu (TW)

(72) Inventor: Hung-Ta Liu, Hsinchu (TW)

( * ) Notice: Subject to any disclaimer, the term of this patent is extended or adjusted under 35 U.S.C. 154(b) by 141 days.

(21) Appl. No.: 13/865,214

(22) Filed: Apr. 18, 2013

(65) Prior Publication Data

US 2013/0278644 A1 Oct. 24, 2013

(30) Foreign Application Priority Data

Apr. 20, 2012 (TW) ..... 101114139 A

(51) Int. Cl.
*G09G 3/36* (2006.01)
*G09G 5/02* (2006.01)
*G09G 3/34* (2006.01)

(52) U.S. Cl.
CPC ..... *G09G 5/026* (2013.01); *G09G 3/342* (2013.01); *G09G 3/3607* (2013.01); *G09G 2310/0235* (2013.01); *G09G 2320/0242* (2013.01)

(58) Field of Classification Search
USPC ..... 345/102
See application file for complete search history.

(56) References Cited

U.S. PATENT DOCUMENTS

| | | | | |
|---|---|---|---|---|
| 2003/0043107 | A1 | 3/2003 | Ruby et al. | |
| 2007/0222743 | A1* | 9/2007 | Hirakata | 345/102 |
| 2008/0203929 | A1* | 8/2008 | Park et al. | 315/158 |
| 2009/0244097 | A1* | 10/2009 | Estevez | 345/633 |
| 2010/0060671 | A1* | 3/2010 | Park et al. | 345/690 |
| 2011/0157244 | A1* | 6/2011 | Nakano et al. | 345/690 |

FOREIGN PATENT DOCUMENTS

| | | | |
|---|---|---|---|
| CN | 101083774 | A | 12/2007 |
| CN | 101149904 | A | 3/2008 |
| CN | 101226291 | A | 7/2008 |
| CN | 101363999 | A | 2/2009 |
| EP | 1936601 | A1 | 6/2008 |
| JP | 2007114276 | A | 5/2007 |

* cited by examiner

*Primary Examiner* — Long D Pham
(74) *Attorney, Agent, or Firm* — Li & Cai Intellectual Property (USA) Office

(57) ABSTRACT

A display control method used in a display with color light sources. Whether a frame is tending to at least one of colors of color lights is determined. When the frame is tending to the at least one of the colors, executing at least one of steps of: (1) adjusting the corresponding color source of the frame to which color the frame is not tending to be weak, dark, or even turned off, and (2) adjusting the corresponding color light source of the frame to which color the frame is tending to be strong or light.

20 Claims, 13 Drawing Sheets

DISPLAY CONTROL METHOD FOR ADJUSTING COLOR LIGHT SOURCE CORRESPONDING TO COLOR DATA

BACKGROUND

1. Technical Field

The present disclosure relates to a display control method used in a display, in particular, to the display control method in the display with color light sources.

2. Description of Related Art

Nowadays, the display technology develops rapidly, in which the liquid crystal display (LCD) is widely used, and selected as the video outputting device to each of electronic apparatuses. The currently marketed LCD is usually a display with a white light source, and the display with the white light source has a LCD panel filled with liquid crystal and the white light source, wherein the LCD panel has a thin film transistor (TFT) array and color filters corresponding to pixels.

Since the liquid crystal does not have color, the pixel is divided into three sub-pixels, and the three sub-pixels respectively have a red color filter, a green color filter, and a blue color filter, such that the display with a white light source can display in colors.

A transmission rate of each sub-pixel on the LCD panel can be adjusted according to a driving voltage (i.e. source driving signal) received by a source of the TFT corresponding to the sub-pixel. To put it concretely, without applying the voltage, a phase of a light would change due to a phase difference of a liquid crystal particle. When the liquid crystal box is a twisted nematic liquid crystal box, if a proper phase difference of the liquid crystal particle is designed well, the light between the liquid crystal box and the positive and negative polarizer can pass through. When a voltage is applied, the liquid crystal particle re-arrange, and the phase difference of the light changes, such that at least a portion of the light is blocked. In short, the liquid crystal corresponding to the sub-pixel is controlled by adjusting the driving voltage of the TFT corresponding to the sub-pixel, and thus the transmission rate of the liquid crystal corresponding to the sub-pixel is adjusted (i.e. the transmission rate of the liquid crystal relates to the applied voltage or electrical field).

By using the adjust of the transmission rates of the sub-pixels associated with each pixel and the function of the color filters, a display color and a display brightness of the pixel is determined by a red light intensity, a green light intensity, and a blue light intensity of the sub-pixels on the space of the pixel.

In addition, a LCD panel in the LCD of another type does not have color filters, and the LCD of the type is also called color sequence display. The color sequence display has the red light source, the green light source, and the blue light source. Regarding the display with the color light sources, the frame-period is divided into a first frame sub-period, a second sub frame-period, and a third sub frame-period. The red light source, the green light source, and the blue light source are respectively turned on during the first frame sub-period, a second sub frame-period, and a third sub frame-period. Thus, the display with the color light sources can successfully display the colors of the pixels indicated by the video data. In short, each pixel's display color and display brightness of the display with the color light sources are formed by the red light intensity, the green light intensity, and the blue light intensity which the red light, the green light, and the blue light passed through liquid crystal box respectively during the different periods.

However, when the color sequence display continuously displays frames, if the frames have an object which moves fast, a phenomenon of color break is induced. Even, when a finger or an object is swaying in the front side of the user's eyes, the display with the color light sources may also have the phenomenon of color break. Thus, for the user, a display performance of the display with the color light sources is not better than that that of the display with the white light source.

To solve the mentioned above problem, a liquid crystal material with a fast liquid crystal responding speed (the liquid crystal responding time for each pixel must be less than 4 micro-second) is thus needed, and the corresponding frame rate must change to 180 hertz or even 240 hertz from the original 60 hertz. However, the current marketed liquid crystal material can achieve the responding speed requirement hardly. Additionally, even the current marketed liquid crystal material can achieve the responding speed requirement, but the color sequence display manufactured by the manner has an extraordinarily high cost.

Furthermore, regarding the normal white LCD display, for example, the twist nematic (TN) LCD display, when reducing the transmission rate of the normal white LCD display, a higher driving voltage is applied to control the liquid crystal. Thus, when at least part of the frame has the smaller brightness (i.e. some pixels have the smaller brightness), the normal white LCD display may have the higher power consumption. By contrast, regarding the normal black LCD display, for example, a fringe field switching (FFS) LCD display, a multi-domain vertical align (MVA) LCD display, or a in-plane switching LCD display, when increasing the transmission rate of the normal white LCD display, a higher driving voltage is applied to control the liquid crystal. Thus, when at least part of the frame has the higher brightness (i.e. some pixels have the smaller brightness), the normal white LCD display may have the higher power consumption.

SUMMARY

An exemplary embodiment of a display control method used in a display with color light sources, wherein the color light sources respectively provides color lights with colors. Firstly, execute at least one of steps of: (1) determining whether a frame is tending to at least one of colors, and (2) determining whether the frame relatively lacks at least one of the colors. If the frame is tending to the at least one of the colors, execute at least one of steps of: (1) adjusting the corresponding color light source of the frame to which color the frame is not tending to be weak, dark, or turned off, and (2) adjusting the corresponding color light source of the frame to which color the frame is tending to be strong or bright; if the frame relatively lacks the at least one of the colors, execute at least one of steps of: (1) adjusting the corresponding color light source of the frame which color the frame relatively lacks be weak, dark, or turned off, and (2) adjusting the corresponding color light source of the frame which color the frame does not relatively lack to be strong or bright.

An exemplary embodiment of a display control method used in a display with color light sources, wherein the color light sources respectively provides color lights with colors. When the display is a normal white display, execute at least one of steps of: (1) determining whether at least one of frame gray levels of the colors associated with the frame is less than a frame gray level threshold, (2) determining whether at least one of frame transmission rates of the colors associated with the frame is less than a frame transmission rate threshold, (3) determining whether at least one of frame darkness levels of the colors associated with the frame achieves a frame darkness threshold, and (4) determining whether at least one of frame driving voltages of the colors associated with the frame corresponding to the frame transmission rates of the colors associated with the frame is higher than a frame driving voltage threshold. When the display is the normal white display, under at least one of conditions of: (1) the at least one of the frame gray levels of the colors associated with the frame is less than the frame gray level threshold, (2) the at least one of the frame transmission rates of the colors associated with the frame is less than the frame transmission rate threshold, (3) the at least one of the frame darkness levels of the colors associated with the frame achieves the frame darkness threshold, and (4) the at least one of the frame driving voltages of the colors associated with the frame corresponding to the frame transmission rates of the colors associated with the frame is higher than the frame driving voltage threshold, execute at least one of steps of: (1) increasing the frame gray level of the color less than the frame gray level threshold, (2) increasing the frame transmission rate of the color less than the frame transmission rate threshold, (3) increasing the frame darkness level of the color achieving the frame darkness threshold, and (4) decreasing the frame driving voltage of the color associated with the frame corresponding to the frame transmission rate of the color associated with the frame higher than the frame driving voltage threshold, and simultaneously execute at least one of another steps of: (1) adjusting the corresponding color light source of the color of the frame to be weak or dark accordingly, (2) decreasing a driving current associated with the corresponding color light source of the color of the frame accordingly, and (3) adjusting an on/off time or a bright/dark time associated with the corresponding color light source of the color of the frame accordingly. When the display is a normal black display, execute at least one of steps of: (1) determining whether at least one of frame gray levels of the colors associated with the frame is less than the frame gray level threshold, (2) determining whether at least one of frame transmission rates of the colors associated with the frame is less than the frame transmission rate threshold, (3) determining whether at least one of frame darkness levels of the colors associated with the frame achieves the frame darkness threshold, and (4) determining whether at least one of frame driving voltages of the colors associated with the frame corresponding to the frame transmission rates of the colors associated with the frame is less than the frame driving voltage threshold. When the display is the normal white display, under at least one of conditions of: (1) the at least one of the frame gray levels of the colors associated with the frame is less than the frame gray level threshold, (2) the at least one of the frame transmission rates of the colors associated with the frame is less than the frame transmission rate threshold, (3) the at least one of the frame darkness levels of the colors associated with the frame achieves the frame darkness threshold, and (4) the at least one of the frame driving voltages of the colors associated with the frame corresponding to the frame transmission rates of the colors associated with the frame is higher than the frame driving voltage threshold, execute at least one of steps of: (1) increasing the frame gray level of the color less than the frame gray level threshold, (2) increasing the frame transmission rate of the color less than the frame transmission rate threshold, (3) increasing the frame darkness level of the color achieving the frame darkness threshold, and (4) increasing the frame driving voltage of the color associated with the frame corresponding to the frame transmission rate of the color associated with the frame less than the frame driving voltage threshold, and simultaneously execute at least one of another steps of: (1) adjusting the corresponding color light source of the color of the frame to be weak or dark accordingly, (2) decreasing a driving current associated with the corresponding color light source of the color of the frame accordingly, and (3) adjusting an on/off time or a bright/dark time associated with the corresponding color light source of the color of the frame accordingly.

To sum up, the display control method provided by the embodiment of the present disclosure can efficiently decrease the power consumption of the display and the phenomenon of the impure gamut after mixing the color lights. In addition, the display control method is easily implemented in the hardware circuit, the software, or the firmware, and thus the cost of the display using the display control method is increased little.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1A:
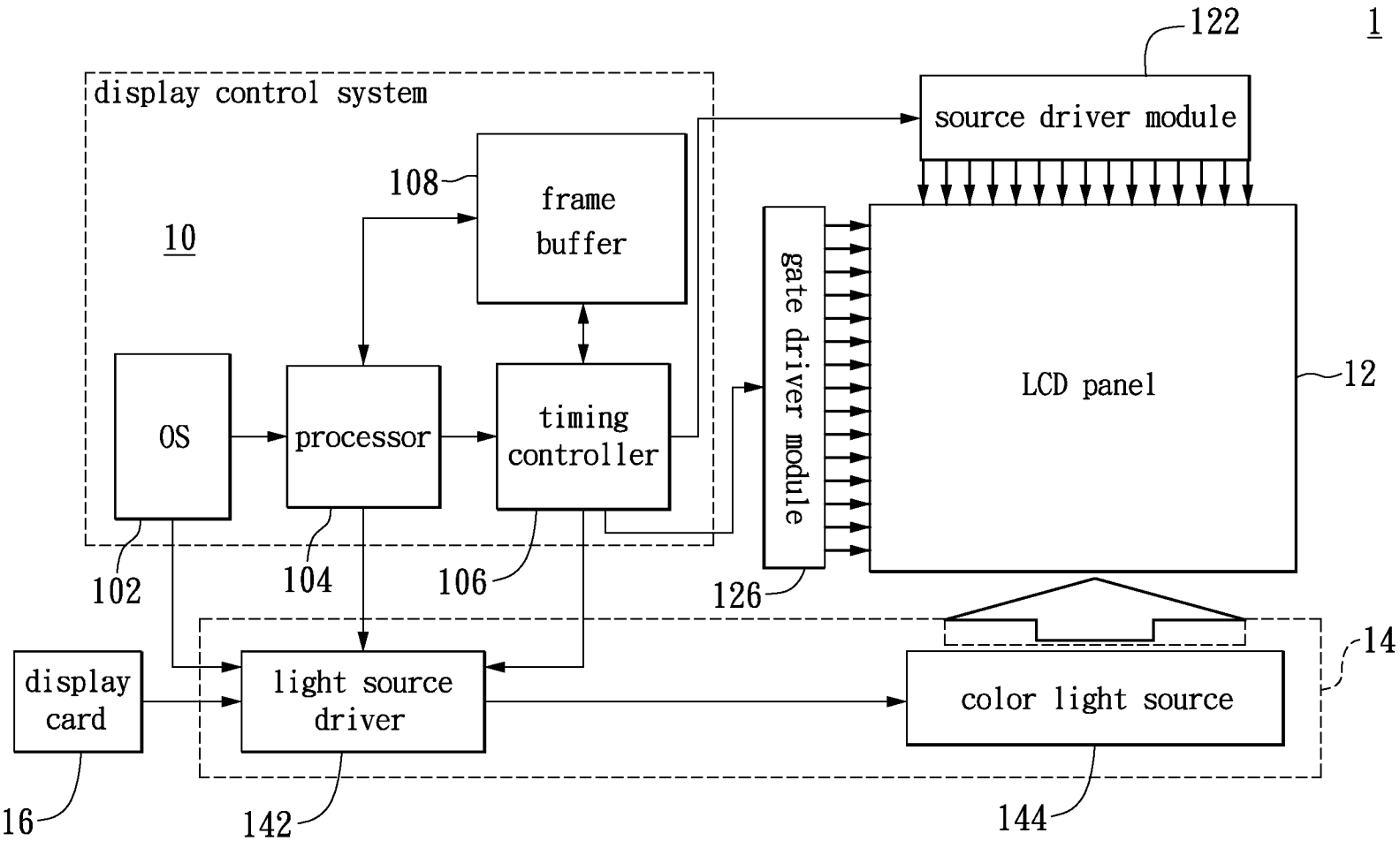
FIG. 1A is block diagram of a display according to one embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

Embodiments of the present disclosure provide a display, a display control system, and a display control method, so as to reduce the phenomenon of the impure gamut induced in the display after the color lights are mixed, and to reduce the power consumption of the back-light source of the display. In addition, the display and the display control system of the embodiment of the present disclosure does not have the high complexity, such that the display and the display control system can be produced massively, and have the fairly practicability.

(Embodiment of Display and Display Control System)

Referring to FIG. 1A, FIG. 1A is block diagram of a display according to one embodiment of the present disclosure. The display 1 comprises a display control system 10, a LCD panel 12, a source driver module 124, a gate driver module 126, and a light source module 14. The display control system 10 is electrically connected to the source driver module 122, the gate driver module 126, and the light source module 14.

In the embodiment of the present disclosure, the display 1 can be a display with color light sources, and thus the LCD panel 12 can selectively have the color filters. Furthermore, the light source module 14 can be the back-light source module or the front-light source module having the front light guiding plate, the light source module 16 has a light source driver 142 and color light sources 144, such as red, blue, white, green, cyan, purple, chrysanthemum, and yellow light sources, wherein the color light sources 144 are usually the red, green, and blue light sources, or alternatively the red, green, blue, yellow, and white light sources, and the LCD panel 12 meanwhile has the color filters selectively.

The display control system 10 controls the light source driver 142 to drive each of the color light sources 144, and controls the gate driver module 126 and the source driver module 122. The light source driver 144 receives the control signal from the display control system 10 to generate the driving currents, so as to control the color light sources 144 in the light source module 14 to be turned on/off or bright/dark, and/or to adjust the color lights emitted by the color light sources 144 of the light source module 14 to be strong/weak or bright/dark. The light source module 14 can transmit the color lights generated from the color light sources 144 to the LCD panel 12. Each of the color light sources 144 is turned on/off or the color light thereof is adjusted to be strong/weak or bright/dark according to the received driving current thereof.

The color light sources 144 may provide the color lights to the entire from of the display. In addition, the frame may have at least a sub-frame, and the color light sources 144 may provide corresponding color lights to the sub-frame of the display. In short, the corresponding color light sources 144 providing the color lights to the sub-frame of the display are independently controlled, or each of the color light sources 144 provides the color light to the frame once, or the color light sources 144 provides the color lights to the different sub-frames in a time division manner. Meanwhile, the liquid crystal of each pixel corresponding to the color light source 144 is controlled in the time division manner or the space division manner. For example, the liquid crystal of each pixel corresponding to the color light source 144 is controlled within one of the sub frame-periods.

The gate driver module 126 is controlled by the display control system 10 to generate the gate driving signals to control the TFTs in one row of the TFT matrix in the LCD panel 12 to be turned on/off. The source driver module 122 is controlled by the display control system 10 to generate driving voltages corresponding to the video data to the turned-on TFTs in one row, so as to control the liquid crystals in one row. Therefore, the transmission rates (or called brightness level, and the antonym thereof is called darkness level, but the darkness level is controlled by the color light source 144) in one row can be further adjusted, or the applied driving voltages of liquid crystals of the pixels in one row can be adjusted, or the gray level of the pixels in one row is adjusted.

The display control system 10 comprises an operating system (OS) 102, a processor 104, a timing controller 106, and a frame buffer 108. The OS 102 is electrically connected to the processor 104, and the processor 104 is electrically connected to the timing controller 106 and the frame buffer 108. The timing controller 106 is electrically connected to the frame buffer 108, the light source driver 142, the source driver module 122, and the gate driver module 126.

The OS 102 can be the embedded OS or a general software OS, or the display card control system, and the OS 102 can control the processor 104 to process the video data of the frame, and to execute the display control method. Thus, the display control system can control the color light sources 144 in the light source module 14 to be turned on/off or bright/dark, or to adjust the color lights emitted by the color light sources 144 to be strong/weak or bright/dark. Even, by using the display control method, the display control system 10 can further adjust the frame transmission rate, the frame darkness level, the frame gray level, or the frame driving voltage corresponding to the frame transmission rate of the frame, so as to reduce the power consumption of the display 1.

The frame transmission rate is the statistic value of the transmission rates of the pixels in the frame, for example the average transmission rate of the pixels in the frame, and adjusting the frame transmission rate means adjusting all transmission rates of the pixels in the frame. The frame gray level is the statistic value of the gray levels of the pixels in the frame, for example the average gray level of the pixels in the frame, and adjusting the frame gray level means adjusting all gray levels of the pixels in the frame. The frame driving voltage is the statistic value of the driving voltages of the pixels in the frame, for example the average driving voltage of the pixels in the frame, and adjusting the frame driving voltage means adjusting all driving voltages of the pixels in the frame. The frame darkness level is the statistic value of the darkness levels of the pixels in the frame, for example the average darkness level of the pixels in the frame, and adjusting the frame darkness level means adjusting all darkness levels of the pixels in the frame.

In addition, the video data of the frame can be processed and calculated by the OS 102, external or inside display card 16, and the processor 104 corporately, or can be processed and calculated by the OS 102 or the display card 16 independently so as to execute the display control method. Meanwhile, the OS 102, the display card 16, and the timing controller 106 can be electrically connected to light source driver 142.

The frame buffer 108 is used to receive and buffer the video data of the frame to be displayed. The timing controller 106 receives the determination result (p.s. the display control method is executed to process the video data of the frame to generate the determination result) output from the processor 104, and according to the determination result to control the light source driver 142, the source driver module 122, and the gate driver module 126, so as to control the light sources 144 of the light source module 14 to be turned on/off or bright/dark, adjust the color lights emitted by the light sources 144 to be strong/weak or bright/dark, and even adjust the frame value of the frame (such as the frame transmission rate, the frame darkness level, the frame gray level, or the frame driving voltage) and a gray level curve.

It is noted that, the display 1 in FIG. 1A is not used to limit the present disclosure. In the embodiment of the present disclosure, the display 1 can be a TFT LCD display, a transmission projection display, a reflection projection display, a reflection micro-display, or a display with color light emission diodes (LEDs), a color organic light emission diodes (OLEDs), or color electroluminescence (EL) devices. The transmission or reflection projection display is a high temperature poly-silicon (HTPS) liquid crystal transmission or reflection projection display, a low temperature poly-silicon (LTPS) liquid crystal transmission or reflection projection display, or a liquid crystal on silicon (LCOS) transmission or reflection projection display. The reflection projection display can be a digital light processing (DLP) reflection projection display, a liquid crystal on silicon reflection projection display, or a micro optic electro mechanics system (MOEMS) reflection projection display. In addition, the color light source can be a color laser light source, a color LED, a color electroluminescence device, a cold cathode fluorescent lamp (CCFL), a mercury lamp with a color filter or a color wheel, or a helium lamp with the color filter or the color wheel.

Figure 1B:
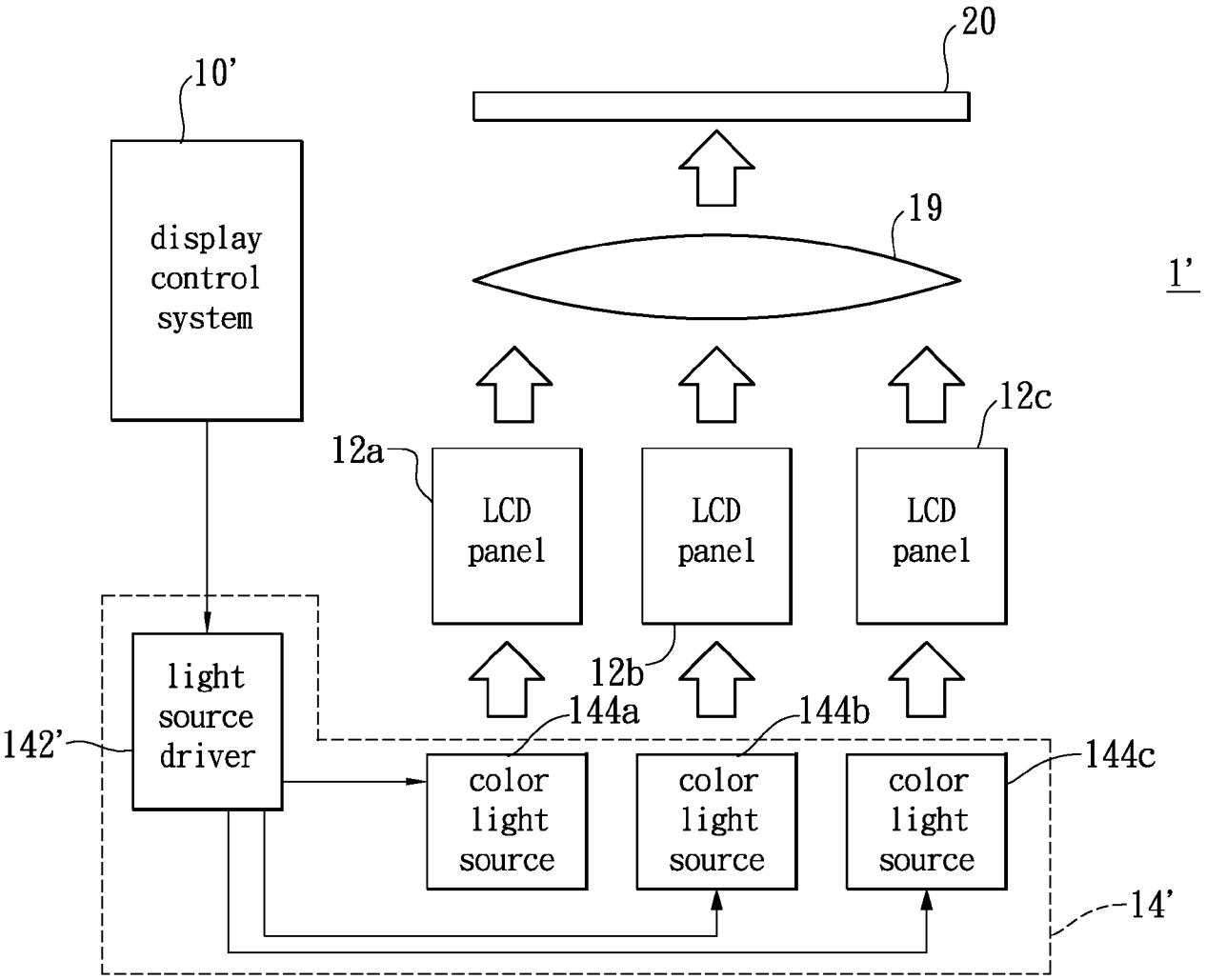
FIG. 1B is block diagram of a display according to another embodiment of the present disclosure.

Referring to FIG. 1B, FIG. 1B is block diagram of a display according to another embodiment of the present disclosure. The display 1' in FIG. 1B is the HTPS transmission projection display. The display 1' comprises a display control system 10', a source driver module (not shown FIG. 1B), a gate driver module (not shown in FIG. 1B), a light source module 14', LCD panels 12*a* through 12*c*, and a condensing len 19. The light source module 14' has a light source driver 142' and color light sources 144*a* through 144*c*. The display control system 10' and the light source driver 142' are substantially the same as the display control system 10 and the light source driver 142 in FIG. 1A, and thus the redundant description is omitted. The source driver modules and the gate driver modules in the display 1' are corresponding to the LCD panels 12*a* through 12*c*, and the source driver modules and the gate driver modules are substantially the same as the source driver module 124 and the gate driver module 16 in FIG. 1A, and thus the redundant description is omitted.

In FIG. 1B, the color light sources 144*a* through 144*c* are used to respectively generate color lights with different colors to the LCD panels 12*a* through 12*c*. The color lights passing through the LCD panels 12*a* through 12*c* are collected by the condensing len 19, and the condensing len 19 focuses the collected color lights, so as to project a corresponding frame on the screen 20. In short, the display control method provided by the embodiment of the present disclosure can be used in the displays of different kinds, and the kind of the display is not used to limit the present disclosure.

In the following embodiments, how the display control method processes and calculates the video data of the frame to control the color light sources in the light source module to be turned on/off or bright/dark, to adjust the color lights emitted by the light sources 144 to be strong/weak or bright/dark, and even to adjust the frame transmission rate, the frame darkness level, the frame gray level, or the frame driving voltage and a gray level curve is stated in details.

(Embodiment of Display Control Method)

Figure 2:
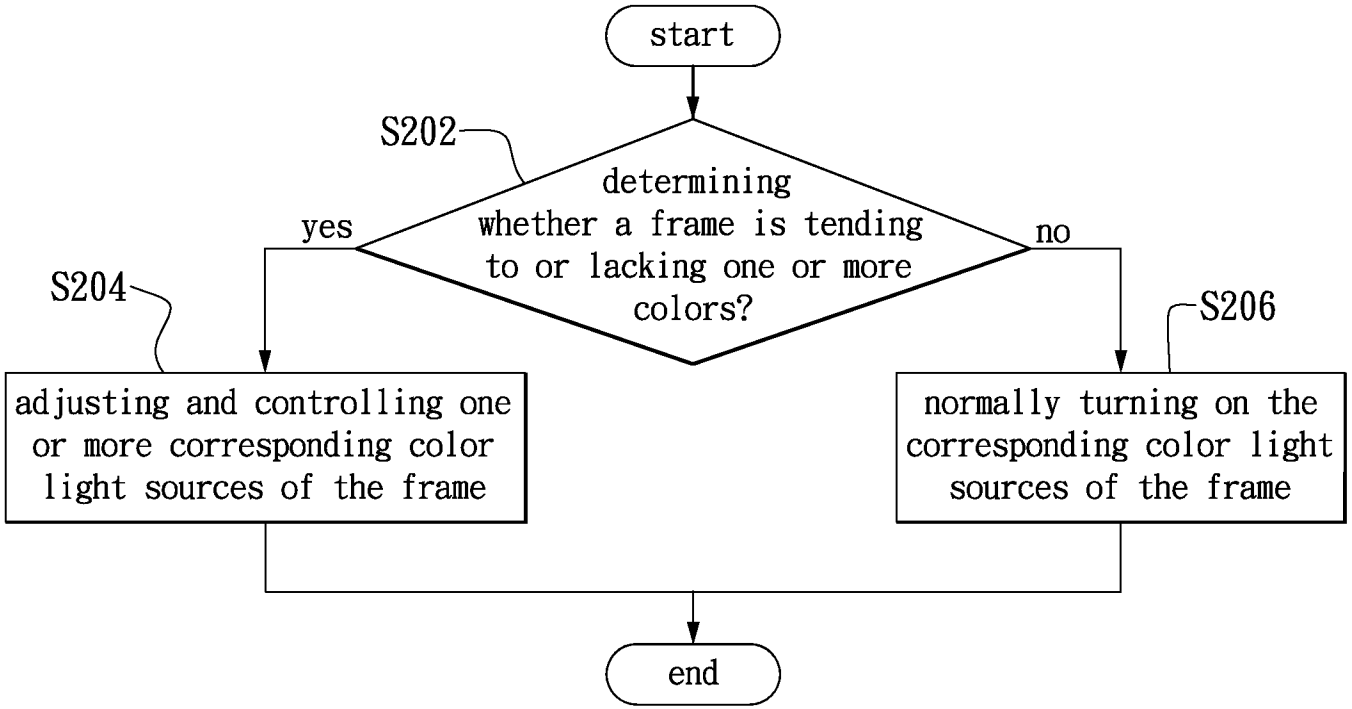
FIG. 2 is a flow chart of a display control method according to one embodiment of the present disclosure.

Referring to FIG. 1A and FIG. 2, FIG. 2 is a flow chart of a display control method according to one embodiment of the present disclosure. At step S202, the processor 104 or the OS 102 processes or calculates the video data of the frame, to determine whether the frame is tending to some color or relatively lacks some color, and that is, to determine whether the frame is tending to at least one of colors associated with the color light sources 144, or to determine whether the frame relatively lacks at least one of colors associated with the color light sources 144.

Next, if the determination result shows that the frame is tending to the least one color of the color associated with the color light sources 144, or the determination result shows that the frame relatively lacks the least one color of the color associated with the color light sources 144, step S204 is executed. If the determination result shows that the frame is not tending to the least one color of the color associated with the color light sources 144, and the determination result shows that the frame does not relatively lack the least one color of the color associated with the color light sources 144, step S206 is executed.

At step S204, the timing controller 106 controls the light source driver 142 to generate the driving currents to the corresponding color light sources 144 of the frame in the light source module 14 according to the determination result, so as to control or adjust the corresponding color light sources 144 of the frame. To put it concretely, if the frame is tending to the least one color of the color associated with the color light sources 144, the corresponding color light source 144 of the frame to which color the frame is tending is adjusted to be strong or bright, and/or the corresponding color light source of the frame to which color the frame is not tending is adjusted to be weak, dark, or turned off (comprising entirely turning off the color light source 144 or reducing the turned-on time of the color light source 144 within the frame period). If the frame relatively lacks the at least one of the colors associated with the corresponding color light sources 144 of the frame, the corresponding color light source 144 of the frame which color the frame relatively lacks is adjusted to be weak, dark, or turned off, and/or the corresponding color light source 144 of the frame which color the frame does not relatively lack to be strong or bright. At step S206, the timing controller 106 controls the light source driver 142 to generate the driving currents to the corresponding color light sources 144 of the frame in the light source module 14 according to the determination result, so as to normally turn on the corresponding color light sources of the frame, i.e. not to adjust the corresponding color light sources 144 of the frame to be strong, weak, and dark, and not to turn off the corresponding color light sources 144 of the frame. Thus, by using the display control method in the embodiment, the phenomenon of the impure gamut after mixing the color lights can be reduced. Furthermore, since the power consumption of the light source module 14 is the 60% through 70% power consumption of the display 1, the display control method in the embodiment can dramatically reduce the power consumption of the display 1.

By the way, within a frame-period, a driving current associated with the corresponding color light source 144 of the color of the frame is decreased gradually or step by step, so as to decrease an intensity or luminance of the color light emitted by the corresponding color light source 144 associated with the color of the frame. However, the implementation is not used to limit the present disclosure.

An example assuming that the color light sources 144 comprising red, green, and blue light sources is explained as follows. When the frame is tending to red, the display control method adjusts the corresponding red color light sources of the frame to be strong or bright, and/or the corresponding green and blue color light sources of the frame are adjusted to be weak, dark, or turned off. When the frame lacks green and blue, the display control method adjusts the corresponding green and blue color light sources of the frame to be weak, dark, or turned off, and/or the corresponding red color light sources of the frame is adjusted to be strong or bright. When the frame is tending to cyan (i.e. mixed by the blue and green lights), the display control method adjusts the corresponding blue and green color light sources of the frame to be strong or bright, and/or the corresponding red color light sources of the frame are adjusted to be weak, dark, or turned off. When the frame lacks red, the display control method adjusts the corresponding red color light sources of the frame to be weak, dark, or turned off, and/or the corresponding green and blue color light sources of the frame is adjusted to be strong or bright. When the frame is not tending to any color and does not lack any color, for example, the frame is white (i.e. mixed by the red, green, and blue lights), the corresponding color light sources 144 of the frame is normally turned on.

(Another Embodiment of Display Control Method)

Figure 3:
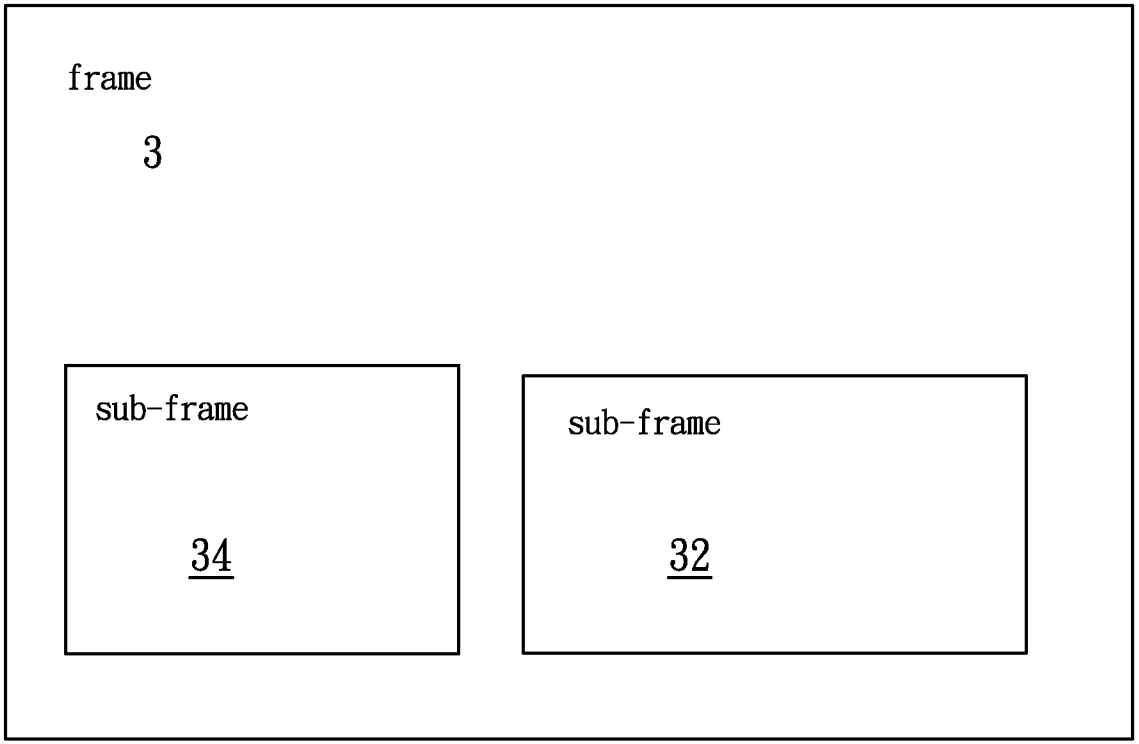
FIG. 3 is a schematic diagram of a frame displayed the display according to one embodiment of the present disclosure.

Referring to FIG. 3, FIG. 3 is a schematic diagram of a frame displayed the display according to one embodiment of the present disclosure. The frame 3 may have at least one sub-frame, for example the sub-frames 32 and 34, wherein the sub-frames 32 and 34 are divided parts of the frame 3 defined by a software, a firmware, or a hardware. In the previous embodiment of the present disclosure, the display control method controls the corresponding color light sources of the frame 3 to be turned on/off or bright/dark, and adjusts color lights emitted by the corresponding color light sources of the frame 3 to be strong/weak or bright/dark according to the video data of the entire frame 3. However, in the embodiment of the present disclosure, the display control method controls the corresponding color light sources of the sub-frames 32 and 34 to be turned on/off or bright/dark, and adjusts color lights emitted by the corresponding color light sources of the sub-frames 32 and 34 to be strong/weak or bright/dark according to the video data of the 32 and 34. Even, in the other embodiment, the display control method may control the corresponding color light sources of the frame 3 and the sub-frames 32, 34 to be turned on/off or bright/dark, and adjusts color lights emitted by the corresponding color light sources of the s frame 3 and the sub-frames 32, 34 to be strong/weak or bright/dark. In short, after the person with ordinary skill in the art reads all embodiments of the present disclosure, she/he can combine steps in the different embodiments to obtain her/his required display control method, and thus each embodiment of the present disclosure is not used to limit the present disclosure.

Figure 4:
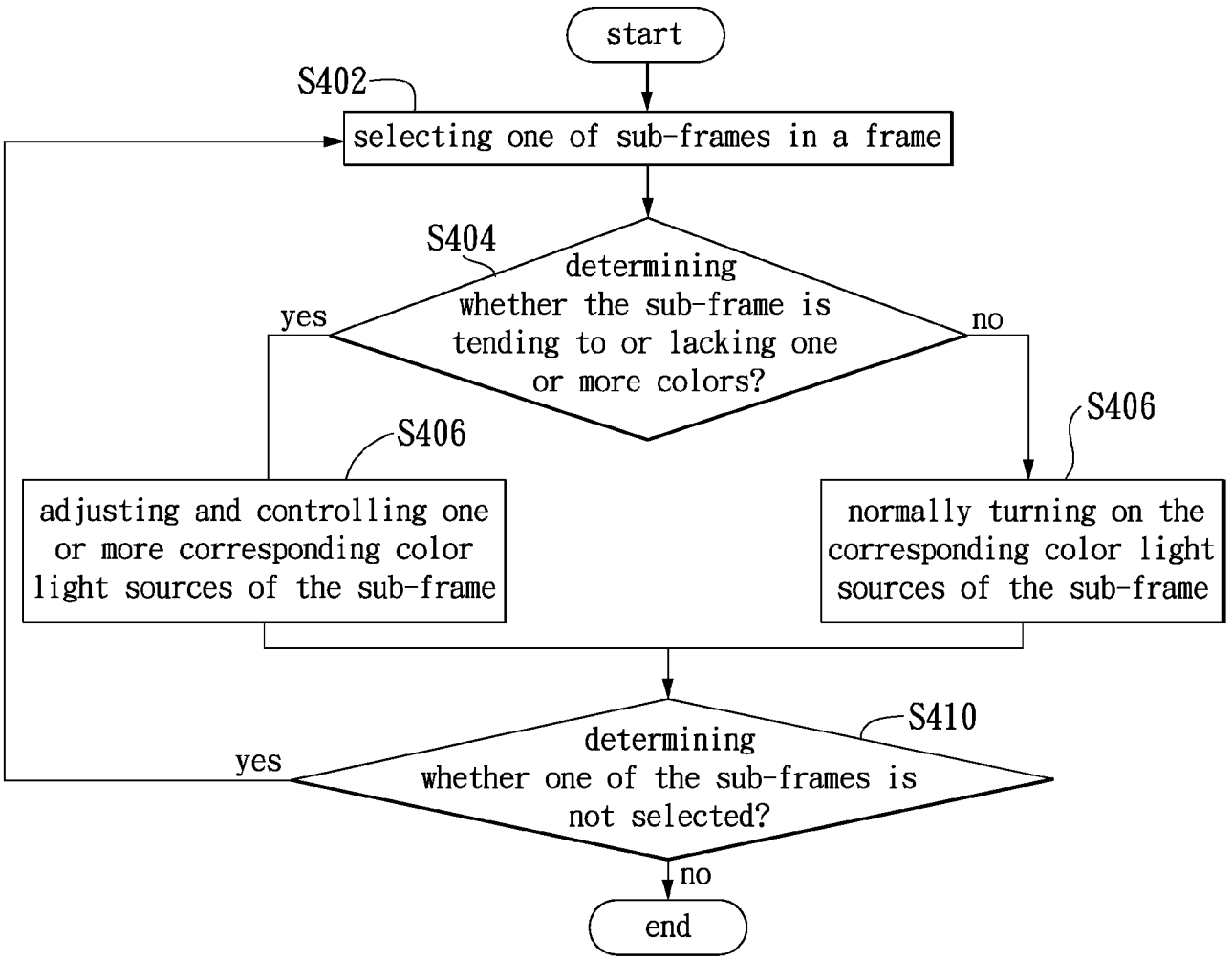
FIG. 4 is a flow chart of a display control method according to another embodiment of the present disclosure.

Referring to FIG. 1A, FIG. 3, and FIG. 4, FIG. 4 is a flow chart of a display control method according to another embodiment of the present disclosure. At step S402, the processor 104 or the OS 102 selects one of the sub-frames 32 and 34 of the frame 3 (p.s. the following description assumes the sub-frame 32 is selected). At step S404, the processor 104 or the OS 102 processes or calculates the video data of the sub-frame 32, to determine whether the sub-frame 32 is tending to some color or relatively lacks some color, and that is, to determine whether the sub-frame 32 is tending to at least one of colors associated with the color light sources 144, or to determine whether the sub-frame 32 relatively lacks at least one of colors associated with the color light sources 144.

Next, if the determination result shows that the sub-frame 32 is tending to the least one color of the color associated with the color light sources 144, or the determination result shows that the sub-frame 32 relatively lacks the least one color of the color associated with the color light sources 144, step S406 is executed. If the determination result shows that the sub-frame 32 is not tending to the least one color of the color associated with the color light sources 144, and the determination result shows that the sub-frame 32 does not relatively lack the least one color of the color associated with the color light sources 144, step S408 is executed.

At step S406, the timing controller 106 controls the light source driver 142 to generate the driving currents to the corresponding color light sources 144 of the sub-frame 32 in the light source module 14 according to the determination result, so as to control or adjust the corresponding color light sources 144 of the sub-frame 32. To put it concretely, if the sub-frame 32 is tending to the least one color of the color associated with the color light sources 144, the corresponding color light source 144 of the sub-frame 32 to which color the sub-frame 32 is tending is adjusted to be strong or bright, and/or the corresponding color light source of the sub-frame 32 to which color the sub-frame 32 is not tending is adjusted to be weak, dark, or turned off. If the sub-frame 32 relatively lacks the at least one of the colors associated with the corresponding color light sources 144 of the sub-frame 32, the corresponding color light source 144 of the sub-frame 32 which color the sub-frame 32 relatively lacks is adjusted to be weak, dark, or turned off, and/or the corresponding color light source 144 of the sub-frame 32 which color the sub-frame 32 does not relatively lack to be strong or bright. At step S408, the timing controller 106 controls the light source driver 142 to generate the driving currents to the corresponding color light sources 144 of the sub-frame 32 in the light source module 14 according to the determination result, so as to normally turn on the corresponding color light sources of the sub-frame 32, i.e. not to adjust the corresponding color light sources 144 of the sub-frame 32 to be strong, weak, and dark, and not to turn off the corresponding color light sources 144 of the sub-frame 32.

At step S410, the processor 104 or OS 102 determines whether a sub-frame 32 or 34 is not selected. If the sub-frame 32 or 34 is not selected, step S402 is executed. If all of the sub-frames 32 and 34 are selected, the display control method is terminated. Thus, by using the display control method in the embodiment, the phenomenon of the impure gamut after mixing the color lights can be reduced.

By the way, respectively within the sub frame-periods, a driving current associated with the corresponding color light source of the color of the sub-frame is decreased gradually or step by step, so as to decrease an intensity or luminance of each the color light emitted by the corresponding color light source associated with the color of the sub-frame. However, the implementation is not used to limit the present disclosure.

An example assuming that the color light sources 144 comprising red, green, and blue light sources is explained as follows. When the sub-frame 32 is tending to red, the display control method adjusts the corresponding red color light sources of the sub-frame 32 to be strong or bright, and/or the corresponding green and blue color light sources of the sub-frame 32 are adjusted to be weak, dark, or turned off. When the sub-frame 32 lacks green and blue, the display control method adjusts the corresponding green and blue color light sources of the sub-frame 32 to be weak, dark, or turned off, and/or the corresponding red color light sources of the sub-frame 32 is adjusted to be strong or bright. When the sub-frame 32 is tending to cyan (i.e. mixed by the blue and green lights), the display control method adjusts the corresponding blue and green color light sources of the sub-frame 32 to be strong or bright, and/or the corresponding red color light sources of the sub-frame 32 are adjusted to be weak, dark, or turned off. When the sub-frame 32 lacks red, the display control method adjusts the corresponding red color light sources of the sub-frame 32 to be weak, dark, or turned off, and/or the corresponding green and blue color light sources of the sub-frame 32 is adjusted to be strong or bright. When the sub-frame 32 is not tending to any color and does not lack any color, for example, the sub-frame 32 is white (i.e. mixed by the red, green, and blue lights), the corresponding color light sources 144 of the sub-frame 32 is normally turned on.

It is noted that, the corresponding color light sources of the sub-frames 32, 34 are independently controlled, and within a same frame-period, the corresponding color light sources of the sub-frames 32, 34 are controlled to be turned on/off or bright/dark, or the color lights emitted by the color light sources are adjusted to be strong/weak or bright/dark.

In another embodiment, the frame-period is divided into sub frame-periods, for example, a first through a third sub frame-periods, according to the number of the sub-frames 32, 34. Within the first through third sub frame-periods, the corresponding color light sources of the sub-frames 32 and 34 are controlled to be turned on/off or bright/dark, and the color lights emitted by the corresponding color light sources of the sub-frames 32 and 34 are adjusted to be strong/weak or bright/weak.

Figure 5:
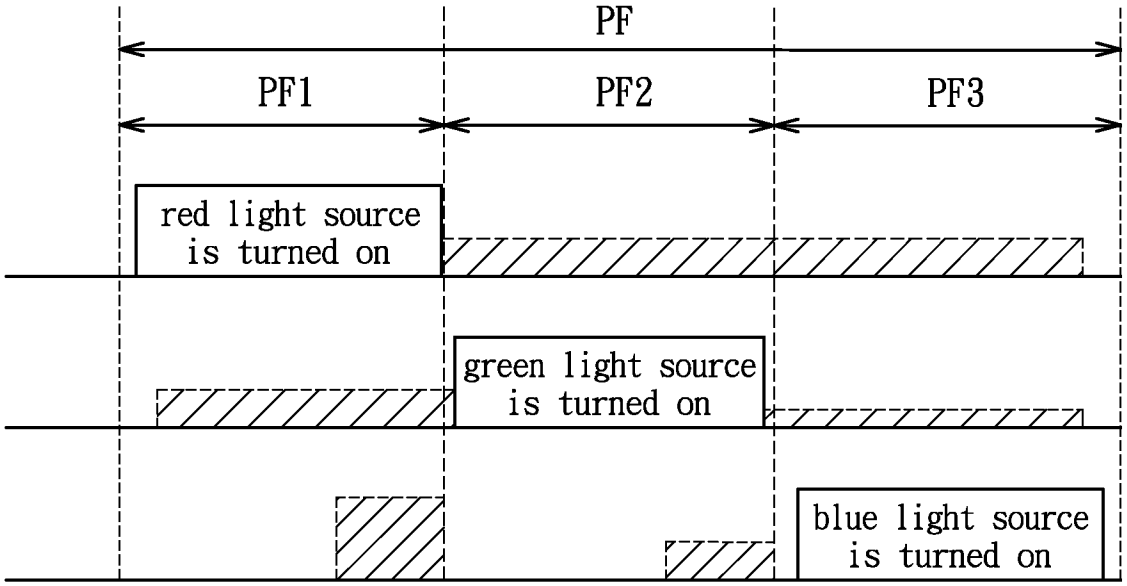
FIG. 5 is a wave form diagram showing driving currents of the color light sources according to one embodiment of the present disclosure.

Referring to FIG. 3 and FIG. 5, FIG. 5 is a wave form diagram showing driving currents of the color light sources according to one embodiment of the present disclosure. In the embodiment, the frame-period PF is divided into a first through third sub frame-periods PF1 through PF3, and the corresponding color light sources of the frame 3, the sub-frame 32, and the sub-frame 34 are controlled to be turned on/off, bright/dark, or strong/weak respectively within the first through third sub frame-periods PF1 through PF3.

When the frame 3 is tending to red (or the frame 3 relatively lacks green and blue), and the sub-frames 32 and 34 are respectively tending to green and blue (or the sub-frame 32 relatively lacks red and blue, and the sub-frame 34 relatively lacks red and green), the corresponding red light source of the frame 3 is turned on within the first sub frame-period PF1 of the frame-period PF, the corresponding green light source of the sub-frame 32 is turned on within the second sub frame-period PF2 of the frame-period PF, and the corresponding blue light source of the sub-frame 34 is turned on within the third sub frame-period PF3 of the frame-period PF.

In addition, the corresponding green and blue light sources of the frame 3 can be adjusted to be weak, dark, turned off, or to decrease the turn-on time thereof (i.e. to increase the turn-off time) within the first sub frame-period PF1 of the frame-period PF, and/or the corresponding red light source of the frame 3 can be adjusted to be strong or bright within the first sub frame-period PF1 of the frame-period PF. The corresponding red and blue light sources of the sub-frame 32 can be adjusted to be weak, dark, turned off, or to decrease the turn-on time thereof (i.e. to increase the turn-off time) within the second sub frame-period PF2 of the frame-period PF, and/or the corresponding green light source of the sub-frame 32 can be adjusted to be strong or bright within the second sub frame-period PF2 of the frame-period PF. The corresponding red and green light sources of the sub-frame 34 can be adjusted to be weak, dark, turned off, or to decrease the turn-on time thereof (i.e. to increase the turn-off time) within the third sub frame-period PF3 of the frame-period PF, and/or the corresponding blue light source of the sub-frame 34 can be adjusted to be strong or bright within the third sub frame-period PF3 of the frame-period PF.

In FIG. 5, the adjusting levels which the green color light source is adjusted to be weak or dark within the sub frame-periods PF1 and PF2 can be different from each other, and the adjusting levels and turned-on/off times which the blue color light source is adjusted to be weak, dark, or turned on/off within the sub frame-periods PF1 and PF2 can be different from each other. In short, the manner for adjusting the color light sources to be turned on/off or bright/dark is not used to limit the present disclosure.

For example, within the early portion of the first sub frame-period PF 1 (before the blue light source is turned on), the frame 3 displays mainly in red, and lacks blue, thus the red light source is normally turned on, the green light source is adjusted to be weak or dark, and the blue light source is turned off. Within the later portion of the first sub frame-period PF 1 (after the blue light source is turned on), the frame 3 displays mainly in red and blue, and lacks green, thus red and blue light sources are normally turned on, and the green light source is adjusted to be weak or dark.

Within the early portion of the second sub frame-period PF2 (before the blue light source is turned on), the frame 3 displays mainly in green, and lacks blue, thus the green light source is normally turned on, the red light source is adjusted to be weak or dark, and the blue light source is turned off. Within the later portion of the second sub frame-period PF2 (after the blue light source is turned on), the frame 3 displays mainly in green, thus green light source is normally turned on, and the red and blue light sources are adjusted to be weak or dark. Within the third sub frame-period PF3, the frame 3 displays mainly in blue, thus blue light source is normally turned on, and the red and green light sources are adjusted to be weak or dark.

(Another Embodiment of Display Control Method)

Figure 6:
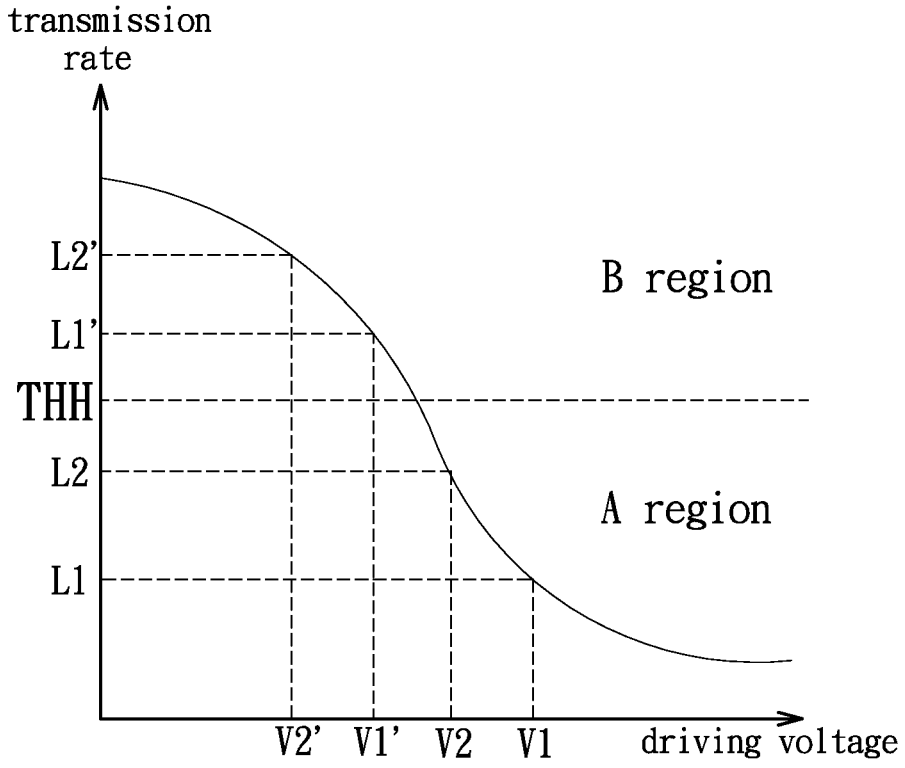
FIG. 6 is a curve diagram showing a driving voltage applied on liquid crystal and the transmission rate of the pixel according to one embodiment of the present disclosure.

Referring to FIG. 6, FIG. 6 is a curve diagram showing a driving voltage applied on liquid crystal and the transmission rate of the pixel according to one embodiment of the present disclosure. As shown in FIG. 6, when the corresponding liquid crystal of the pixel is applied with a higher driving voltage, the corresponding transmission rate of the pixel is decreased, or the corresponding darkness level of the pixel is increased. To make the corresponding transmission rate of the pixel lower than a pixel transmission rate threshold, a higher driving voltage is thus needed, and the falling speed of the corresponding transmission rate of the pixel becomes slower as the driving voltage rises. The lower the frame transmission rate of the entire frame (such as the average transmission rate of the pixels of the frame) is, the higher the driving voltage received by the source of each TFT is, and it leads to a higher power consumption of the display, which does not meet the power saving trend.

In addition, the transmission rate of the pixel relates to the gray level of the pixel, and thus the lower the gray level of the pixel is, the lower the transmission rate of the pixel is. If the gray level of the pixel can be increased in advance, the transmission rate of the pixel can thus be decreased, such that the driving voltage can be decreased. Meanwhile, since the transmission rate increases, the color light source can be accordingly adjusted to be weak, dark, or the turned-on/off or bright/dark time of the color light source can be controlled accordingly, such that the power consumption of the color light source can be further reduced for achieving a better power saving efficiency.

For example, in FIG. 6, the transmission rates L1 and L2 of the pixel are lower than the pixel transmission rate threshold TTH, and the corresponding driving voltages of the transmission rates L1 and L2 of the pixel are V1 and V2. A specific rate (such as triple) can be given to the transmission rates L1 and L2 of the pixel, such that the transmission rates L1 and L2 of the pixel are raised to L1' and L2', and corresponding driving voltages are V1 and V2 of the transmission rates L1' and L2' of the pixel are V1' and V2', wherein the driving voltages V1 and V2 are respectively smaller than the driving voltages V1 and V2. Meanwhile, according to the reciprocal of the specific rate, the corresponding color light source is adjusted to be weak, dark, or the turned-on/off or bright/dark time of the color light source is controlled, so as to maintain the original color and brightness of the pixel. Thus, the power consumption of the display is reduced.

In addition, regarding the normal black display, the specific rate can also be given to the transmission rate of the pixel less than the transmission rate threshold TTH. Though the corresponding driving voltage of the raised transmission rate of the pixel would be increased, since the corresponding color light source is adjusted to be weak, dark, or the turned-on/off or bright/dark time of the color light source is controlled according to the reciprocal of the specific rate, in order to maintain the original color and brightness of the pixel, the driving current of the color light source is still decreased. The power saving due to the decrease of the driving current of the color light source is larger than the power consumption of the increase of the driving voltage, and thus the power consumption of the display is still reduced.

In short, to increasing the transmission rate, gray level, or darkness level of the pixel, and accordingly to adjust the turned-on/off time or bright/dark time, the power consumption of the display can be reduced.

Figure 7:
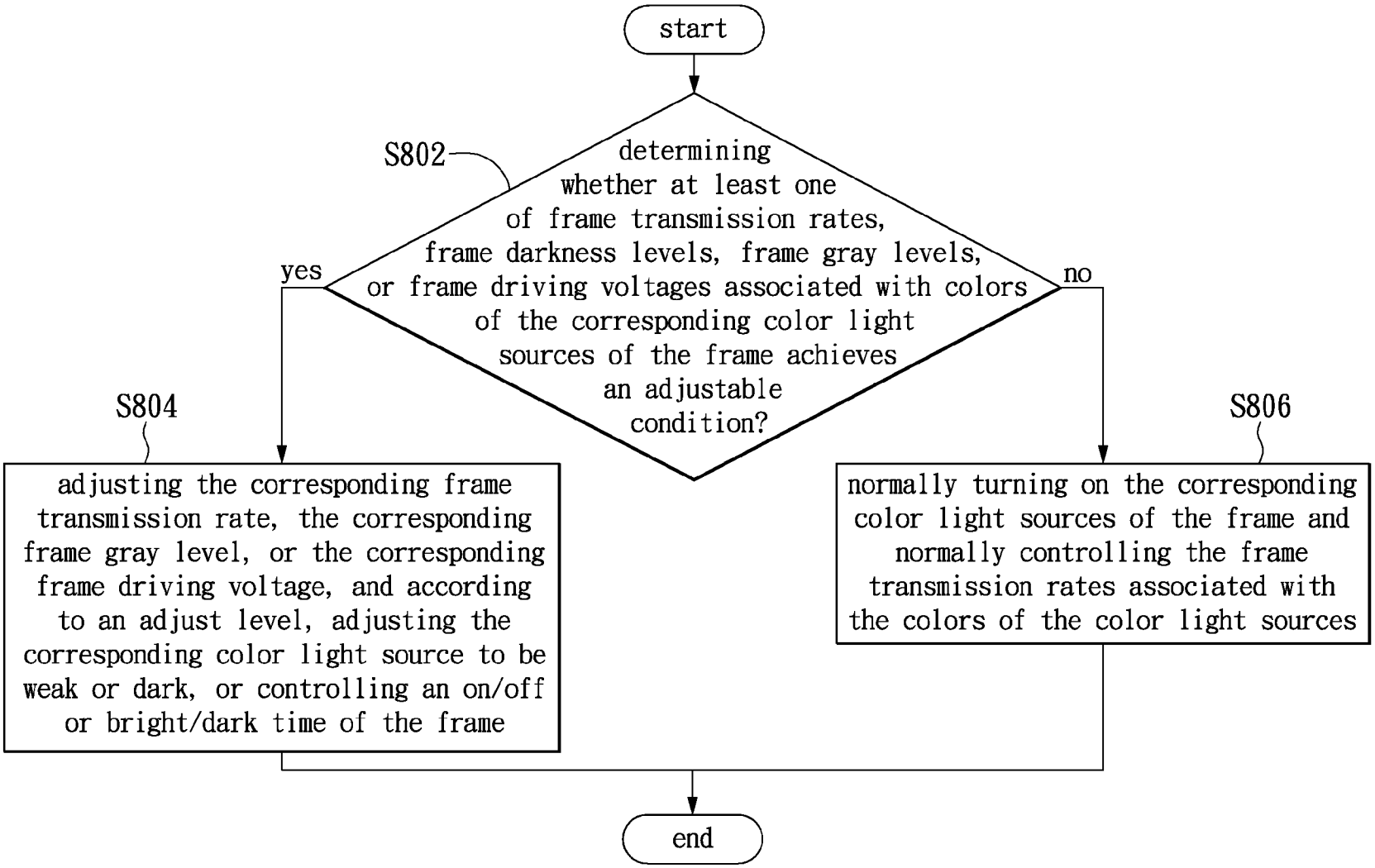
FIG. 7 is a flow chart of a display control method according to another embodiment of the present disclosure.

Referring to FIG. 1A and FIG. 7, FIG. 7 is a flow chart of a display control method according to another embodiment of the present disclosure. At step S802, the processor 104 or the OS 102 processes or calculates the video data of the frame, so as to determine whether at least one of frame transmission rates, frame darkness levels, frame gray levels, or corresponding frame driving voltages associated with colors of the corresponding color light sources 144 of the frame achieves an adjustable condition.

To put it concretely, at step S802, when the display 1 is the normal white display, whether at least one of the frame transmission rates of the colors of the frame is less than the frame transmission rate threshold is determined, or whether at least one of the frame gray levels of the colors of the frame is less than the frame gray level threshold is determined, or whether at least one of the frame darkness levels of the colors of the frame achieves the frame darkness threshold is determined, or whether at least one of the frame driving voltages of the colors associated with the frame corresponding to the frame transmission rates of the colors associated with the frame is higher than the frame driving voltage threshold is determined; when the display 1 is the normal black display, whether at least one of the frame transmission rates of the colors of the frame is less than the frame transmission rate threshold is determined, or whether at least one of the frame gray levels of the colors of the frame is less than the frame gray level threshold is determined, or whether at least one of the frame darkness levels of the colors of the frame achieves the frame darkness threshold is determined, or whether at least one of the frame driving voltages of the colors associated with the frame corresponding to the frame transmission rates of the colors associated with the frame is less than the frame driving voltage threshold is determined.

Next, if the determination result shows that the at least one of frame transmission rates, frame darkness levels, frame gray levels, or corresponding frame driving voltages associated with colors of the corresponding color light sources 144 of the frame achieves the adjustable condition, step S804 is then executed. If the determination result shows that the all of frame transmission rates, frame darkness levels, frame gray levels, or corresponding frame driving voltages associated with colors of the corresponding color light sources 144 of the frame do not achieve the adjustable condition, step S806 is then executed.

At steps S804, the timing controller 106 adjusts the corresponding frame transmission rate, the corresponding frame darkness level, the corresponding frame gray level, or the corresponding frame driving voltage, and according to an adjust level, and adjusts the corresponding color light source 144 of the frame to be weak or dark, or controls an on/off or bright/dark time of the corresponding color light source 144 of the frame. To put it concretely, when the display 1 is the normal white display, under the condition that the at least one of the frame gray levels of the colors associated with the frame is less than the frame gray level threshold, or the at least one of the frame transmission rates of the colors associated with the frame is less than the frame transmission rate threshold, or the at least one of the frame darkness levels of the colors associated with the frame achieves the frame darkness threshold, or the at least one of the frame driving voltages of the colors associated with the frame corresponding to the frame transmission rates of the colors associated with the frame is higher than the frame driving voltage threshold, the frame gray level of the color less than the frame gray level threshold is increased, or the frame transmission rate of the color less than the frame transmission rate threshold is increased, or the frame darkness level of the color achieving the frame darkness threshold is increased, or the frame driving voltage of the color associated with the frame corresponding to the frame transmission rate of the color associated with the frame higher than the frame driving voltage threshold is decreased, and simultaneously, the corresponding color light source 144 of the color of the frame is adjusted to be weak or dark accordingly, or a driving current associated with the corresponding color light source 144 of the color of the frame is decreased accordingly, or an on/off time or a bright/dark time associated with the corresponding color light source 144 of the color of the frame is adjusted accordingly. When the display 1 is the normal black display, under the condition that the at least one of the frame gray levels of the colors associated with the frame is less than the frame gray level threshold, or the at least one of the frame transmission rates of the colors associated with the frame is less than the frame transmission rate threshold, or the at least one of the frame darkness levels of the colors associated with the frame achieves the frame darkness threshold, or the at least one of the frame driving voltages of the colors associated with the frame corresponding to the frame transmission rates of the colors associated with the frame is less than the frame driving voltage threshold, the frame gray level of the color less than the frame gray level threshold is increased, or the frame transmission rate of the color less than the frame transmission rate threshold is increased, or the frame darkness level of the color achieving the frame darkness threshold is increased, or the frame driving voltage of the color associated with the frame corresponding to the frame transmission rate of the color associated with the frame less than the frame driving voltage threshold is increased, and simultaneously, the corresponding color light source 144 of the color of the frame is adjusted to be weak or dark accordingly, or a driving current associated with the corresponding color light source 144 of the color of the frame is decreased accordingly, or an on/off time or a bright/dark time associated with the corresponding color light source 144 of the color of the frame is adjusted accordingly.

For example, if the frame transmission rate of one color is less than the frame transmission rate threshold, the timing controller 106 controls the light source driver 142 to generate the driving currents to the corresponding color light sources 144 of the frame in the light source module 14 according to the determination result, and controls the source driver module 122 to generate the driving voltages to control the transmission rate of the pixel according to the determination result, so as to increase the frame transmission rate of the color less than the frame transmission rate threshold, and adjust corresponding color light source 144 of the color of the frame to be weak or dark accordingly, or adjust an on/off time or a bright/dark time associated with the corresponding color light source 144 of the color of the frame accordingly.

At step S806, the timing controller 106 controls the light source driver 142 to generate the driving currents to the corresponding color light sources 144 of the frame in the light source module 14 according to the determination result, and controls the source driver module 122 to generate the driving voltages to control the transmission rate of the pixel according to the determination result, so as to normally turn on corresponding color light source 144 of the color of the frame, and normally controls the corresponding frame transmission rates of the colors of the color light sources 144, i.e. not to adjust the corresponding color light sources 144 of the frame to be strong, weak, and dark, not to turn off the corresponding color light sources 144 of the frame, and not to increase the corresponding frame transmission rates of the colors of the color light sources 144. In short, the display control method can decrease the driving currents of the light source module 14 of display 1, and thus the power consumption of the display 1 is dramatically reduced.

Next, an example assuming that the color light sources 144 comprising red, green, and blue light sources is explained as follows. When the corresponding red frame transmission rate is less than the frame transmission rate threshold, i.e. the corresponding red frame darkness level achieve the frame darkness level, the display control method increase the corresponding red frame transmission rate with X times the original corresponding red frame transmission rate, i.e. the corresponding red frame darkness level is increased with X times the original corresponding red frame darkness level, and the corresponding red light source of frame is adjusted to be weak or dark with 1/X times the original magnitude or intensity, wherein X is an arbitrary number larger than 1.

In addition, it is noted that, within a frame-period, based on a display driving transformation reference table, according to the adjusting level of the frame gray level, the frame transmission rate, the frame darkness level, or the frame driving voltage of the color, the corresponding color light source 144 of the color of the frame is adjusted to be weak or dark, the driving current associated with the corresponding color light source 144 of the color of the frame is decreased, and/or the on/off time or a bright/dark time associated with the corresponding color light source 144 of the color of the frame is adjusted. However, the above implementation is not used to limit the present disclosure.

Both of the display control methods in the embodiments of FIG. 7 and FIG. 2 can be used in the display. In other words, in the other embodiment, the display control method can control the corresponding color light sources 144 of the frame to be turned on/off or bright/dark, adjust the color lights emitted by the corresponding color light sources 144 to be strong/weak or bright/dark, and adjust the corresponding frame transmission rate of the color of the frame. Thus, the control display method combined by the embodiments of FIG. 2 and FIG. 7 can reduce the phenomenon of the impure gamut induced in the display after the color lights are mixed, and reduce the power consumption of the back-light source of the display 1.

(Another Embodiment of Display Control Method)

The display control method in the embodiment of FIG. 7 adjusts the corresponding frame transmission rate of the color and the corresponding color light source of the color of the frame, to reduce the power consumption of the display. However, the present disclosure is not limited thereto. In the other embodiment, the display control method may adjust the corresponding sub-frame transmission rate of the color and the corresponding color light source of the color of the sub-frame, to reduce the power consumption of the display.

Figure 8:
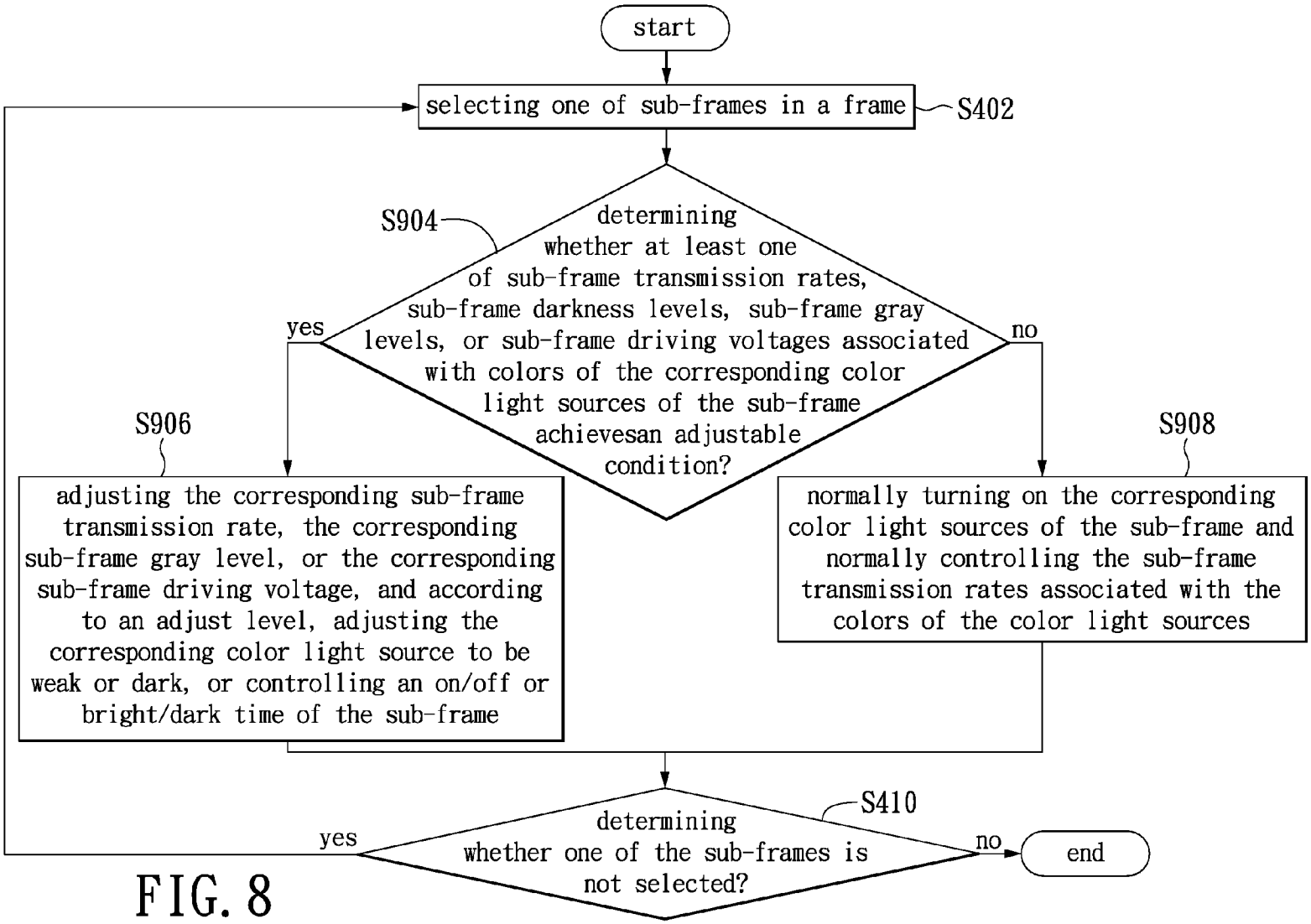
FIG. 8 is a flow chart of a display control method according to another embodiment of the present disclosure.

Referring to FIG. 1A, FIG. 3, and FIG. 8, FIG. 8 is a flow chart of a display control method according to another embodiment of the present disclosure. Steps S402 and S410 in FIG. 8 have been described, and thus the redundant description is omitted. At step S904, the processor 104 or the OS 102 processes and calculates the video data of the sub-frame 32 (assuming the sub-frame 32 is selected at step S402), so as to determine whether at least one of frame transmission rates, frame darkness levels, frame gray levels, or corresponding frame driving voltages associated with colors of the corresponding color light sources 144 of the sub-frame 32 achieves an adjustable condition.

To put it concretely, at step S904, when the display 1 is the normal white display, whether at least one of the sub-frame transmission rates of the colors of the sub-frame 32 is less than the sub-frame transmission rate threshold is determined, or whether at least one of the sub-frame gray levels of the colors of the sub-frame 32 is less than the sub-frame gray level threshold is determined, or whether at least one of the sub-frame darkness levels of the colors of the sub-frame 32 achieves the sub-frame darkness threshold is determined, or whether at least one of the sub-frame driving voltages of the colors associated with the sub-frame 32 corresponding to the sub-frame transmission rates of the colors associated with the sub-frame 32 is higher than the sub-frame driving voltage threshold is determined; when the display 1 is the normal black display, whether at least one of the sub-frame transmission rates of the colors of the sub-frame 32 is less than the sub-frame transmission rate threshold is determined, or whether at least one of the sub-frame gray levels of the colors of the sub-frame 32 is less than the sub-frame gray level threshold is determined, or whether at least one of the sub-frame darkness levels of the colors of the sub-frame 32 achieves the sub-frame darkness threshold is determined, or whether at least one of the sub-frame driving voltages of the colors associated with the sub-frame 32 corresponding to the sub-frame transmission rates of the colors associated with the sub-frame 32 is less than the sub-frame driving voltage threshold is determined.

Next, if the determination result shows that the at least one of sub-frame transmission rates, sub-frame darkness levels, sub-frame gray levels, or corresponding sub-frame driving voltages associated with colors of the corresponding color light sources 144 of the sub-frame 32 achieves the adjustable condition, step S906 is then executed. If the determination result shows that the all of sub-frame transmission rates, sub-frame darkness levels, sub-frame gray levels, or corresponding sub-frame driving voltages associated with colors of the corresponding color light sources 144 of the sub-frame 32 do not achieve the adjustable condition, step S908 is then executed.

At steps S906, the timing controller 106 adjusts the corresponding sub-frame transmission rate, the corresponding sub-frame darkness level, the corresponding sub-frame gray level, or the corresponding sub-frame driving voltage, and according to an adjust level, and adjusts the corresponding color light source 144 of the sub-frame 32 to be weak or dark, or controls an on/off or bright/dark time of the corresponding color light source 144 of the sub-frame 32. To put it concretely, when the display 1 is the normal white display, under the condition that the at least one of the sub-frame gray levels of the colors associated with the sub-frame is less than the sub-frame gray level threshold, or the at least one of the sub-frame transmission rates of the colors associated with the sub-frame 32 is less than the sub-frame transmission rate threshold, or the at least one of the sub-frame darkness levels of the colors associated with the sub-frame achieves the sub-frame darkness threshold, or the at least one of the sub-frame driving voltages of the colors associated with the sub-frame corresponding to the sub-frame transmission rates of the colors associated with the sub-frame is higher than the sub-frame driving voltage threshold, the sub-frame gray level of the color less than the sub-frame gray level threshold is increased, or the sub-frame transmission rate of the color less than the sub-frame transmission rate threshold is increased, or the sub-frame darkness level of the color achieving the frame darkness threshold is increased, or the sub-frame driving voltage of the color associated with the sub-frame 32 corresponding to the sub-frame transmission rate of the color associated with the sub-frame 32 higher than the sub-frame driving voltage threshold is decreased, and simultaneously, the corresponding color light source 144 of the color of the sub-frame 32 is adjusted to be weak or dark accordingly, or a driving current associated with the corresponding color light source 144 of the color of the sub-frame 32 is decreased accordingly, or an on/off time or a bright/dark time associated with the corresponding color light source 144 of the color of the sub-frame 32 is adjusted accordingly. When the display 1 is the normal black display, under the condition that the at least one of the sub-frame gray levels of the colors associated with the sub-frame is less than the sub-frame gray level threshold, or the at least one of the sub-frame transmission rates of the colors associated with the sub-frame 32 is less than the sub-frame transmission rate threshold, or the at least one of the sub-frame darkness levels of the colors associated with the sub-frame achieves the sub-frame darkness threshold, or the at least one of the sub-frame driving voltages of the colors associated with the sub-frame corresponding to the sub-frame transmission rates of the colors associated with the sub-frame is higher than the sub-frame driving voltage threshold, the sub-frame gray level of the color less than the sub-frame gray level threshold is increased, or the sub-frame transmission rate of the color less than the sub-frame transmission rate threshold is increased, or the sub-frame darkness level of the color achieving the frame darkness threshold is increased, or the sub-frame driving voltage of the color associated with the sub-frame 32 corresponding to the sub-frame transmission rate of the color associated with the sub-frame 32 less than the sub-frame driving voltage threshold is increased, and simultaneously, the corresponding color light source 144 of the color of the sub-frame 32 is adjusted to be weak or dark accordingly, or a driving current associated with the corresponding color light source 144 of the color of the sub-frame 32 is decreased accordingly, or an on/off time or a bright/dark time associated with the corresponding color light source 144 of the color of the sub-frame 32 is adjusted accordingly.

For example, if the sub-frame transmission rate of one color is less than the sub-frame transmission rate threshold, the timing controller 106 controls the light source driver 142 to generate the driving currents to the corresponding color light sources 144 of the sub-frame 32 in the light source module 14 according to the determination result, and controls the source driver module 122 to generate the driving voltages to control the transmission rate of the pixel according to the determination result, so as to increase the sub-frame transmission rate of the color less than the sub-frame transmission rate threshold, and adjust corresponding color light source 144 of the color of the sub-frame 32 to be weak or dark accordingly, or adjust an on/off time or a bright/dark time associated with the corresponding color light source 144 of the color of the sub-frame 32 accordingly.

At step S908, the timing controller 106 controls the light source driver 142 to generate the driving currents to the corresponding color light sources 144 of the sub-frame 32 in the light source module 14 according to the determination result, and controls the source driver module 122 to generate the driving voltages to control the transmission rate of the pixel according to the determination result, so as to normally turn on corresponding color light source 144 of the color of the sub-frame 32, and normally controls the corresponding sub-frame transmission rates of the colors of the color light sources 144, i.e. not to adjust the corresponding color light sources 144 of the sub-frame 32 to be strong, weak, and dark, not to turn off the corresponding color light sources 144 of the sub-frame 32, and not to increase the corresponding sub-frame transmission rates of the colors of the color light sources 144. In short, the display control method can decrease the driving currents of the light source module 14 of display 1, and thus the power consumption of the display 1 is dramatically reduced.

Next, an example assuming that the color light sources 144 comprising red, green, and blue light sources is explained as follows. When the corresponding red frame transmission rate is less than the sub-frame transmission rate threshold, i.e. the corresponding red sub-frame darkness level achieve the sub-frame darkness level, the display control method increase the corresponding red sub-frame transmission rate with X times the original corresponding red sub-frame transmission rate, i.e. the corresponding red sub-frame darkness level is increased with X times the original corresponding red sub-frame darkness level, and the corresponding red light source of sub-frame is adjusted to be weak or dark with 1/X times the original magnitude or intensity, wherein X is an arbitrary number larger than 1.

The sub-frame transmission rate is the statistic value of the transmission rates of the pixels in the sub-frame, for example the average transmission rate of the pixels in the sub-frame, and adjusting the sub-frame transmission rate means adjusting all transmission rates of the pixels in the sub-frame. The sub-frame gray level is the statistic value of the gray levels of the pixels in the sub-frame, for example the average gray level of the pixels in the sub-frame, and adjusting the sub-frame gray level means adjusting all gray levels of the pixels in the sub-frame. The sub-frame driving voltage is the statistic value of the driving voltages of the pixels in the sub-frame, for example the average driving voltage of the pixels in the sub-frame, and adjusting the sub-frame driving voltage means adjusting all driving voltages of the pixels in the sub-frame. The sub-frame darkness level is the statistic value of the darkness levels of the pixels in the sub-frame, for example the average darkness level of the pixels in the sub-frame, and adjusting the frame darkness level means adjusting all darkness levels of the pixels in the sub-frame.

In addition, it is noted that, within a frame-period, based on a display driving transformation reference table, according to the adjusting level of the sub-frame gray level, the sub-frame transmission rate, the sub-frame darkness level, or the sub-frame driving voltage of the color, the corresponding color light source 144 of the color of the sub-frame 32 is adjusted to be weak or dark, the driving current associated with the corresponding color light source 144 of the color of the sub-frame 32 is decreased, and/or the on/off time or a bright/dark time associated with the corresponding color light source 144 of the color of the sub-frame 32 is adjusted. However, the above implementation is not used to limit the present disclosure.

Both of the display control methods in the embodiments of FIG. 8 and FIG. 4 can be used in the display 1. In other words, in the other embodiment, the display control method can control the corresponding color light sources 144 of the sub-frame to be turned on/off or bright/dark, adjust the color lights emitted by the corresponding color light sources 144 to be strong/weak or bright/dark, and adjust the corresponding sub-frame transmission rate of the color of the sub-frame. Thus, the control display method combined by the embodiments of FIG. 4 and FIG. 8 can reduce the phenomenon of the impure gamut induced in the display after the color lights are mixed, and reduce the power consumption of the back-light source of the display 1.

All of the display control methods in the embodiments of FIG. 2, FIG. 4, FIG. 7, and FIG. 8 can be used in the display 1. In other words, in the other embodiment, the display control method can control the corresponding color light sources 144 of the frame and the sub-frame to be turned on/off or bright/dark, adjust the color lights emitted by the corresponding color light sources 144 to be strong/weak or bright/dark, and adjust the corresponding the frame and the sub-frame transmission rates of the color of the frame and the sub-frame. Thus, the control display method combined by the embodiments of FIG. 2, FIG. 4, FIG. 7, and FIG. 8 can reduce the phenomenon of the impure gamut induced in the display after the color lights are mixed, and reduce the power consumption of the back-light source of the display 1.

(Another Embodiment of Display Control Method)

As mentioned above, the display in the embodiment of the present disclosure can comprise color light sources and non-white color filter. The color light sources can have the white and non-white light sources, and the non-white light sources comprise at least two of a red light source, a blue light source, a white light source, a green light source, a cyan light source, a purple light source, a chrysanthemum light source, and a yellow light source, and the color light sources can be the LEDs or OLEDs. For example, the white LEDs of the display can be set at the first side of the light guiding plate, and the non-white light LEDs can be set at the second side of the light guiding plate, wherein the first side is the neighbor side of the second side, or the white LEDs and the non-white light LEDs can be set at the same side of the light guiding plate.

Figure 9:
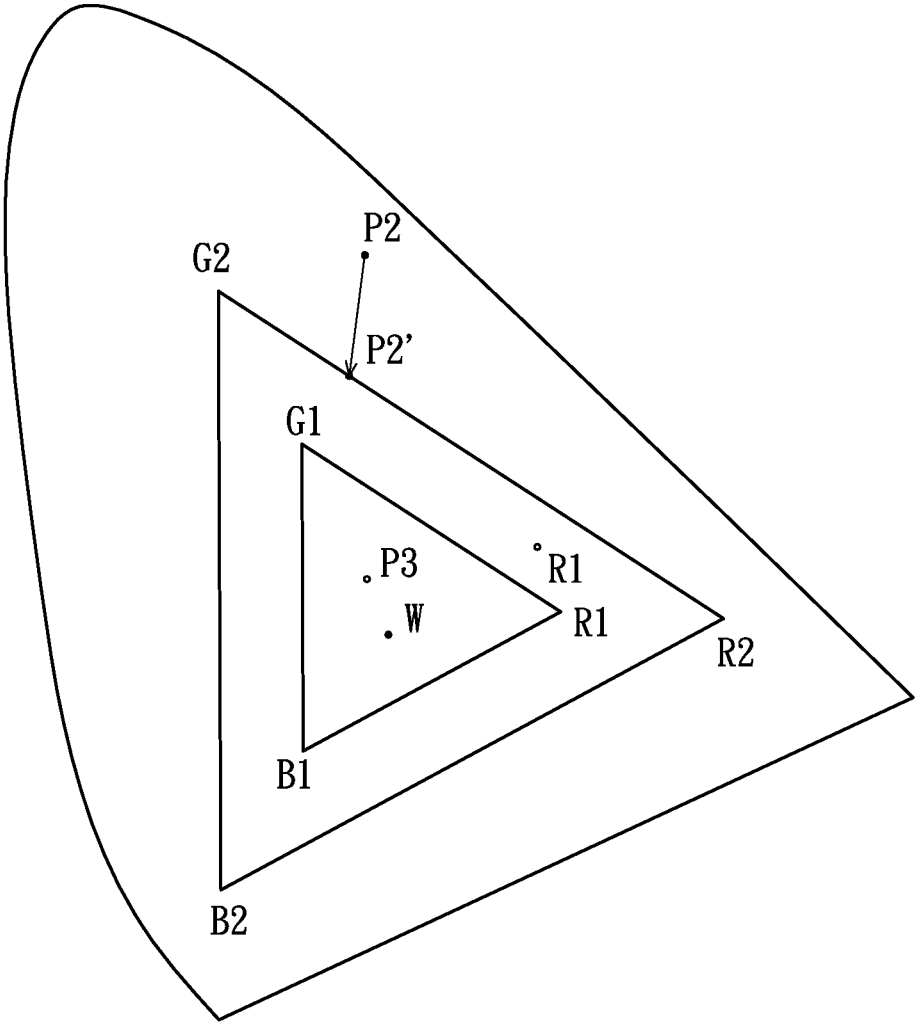
FIG. 9 is a schematic diagram showing a first gamut and a second gamut in CIE 1931 color chromaticity diagram according to one embodiment of the present disclosure when the display adopts a white light emission diode, a red light emission diode, a green light emission diode, and a blue light emission diode as the color light source thereof.
Figure 10:
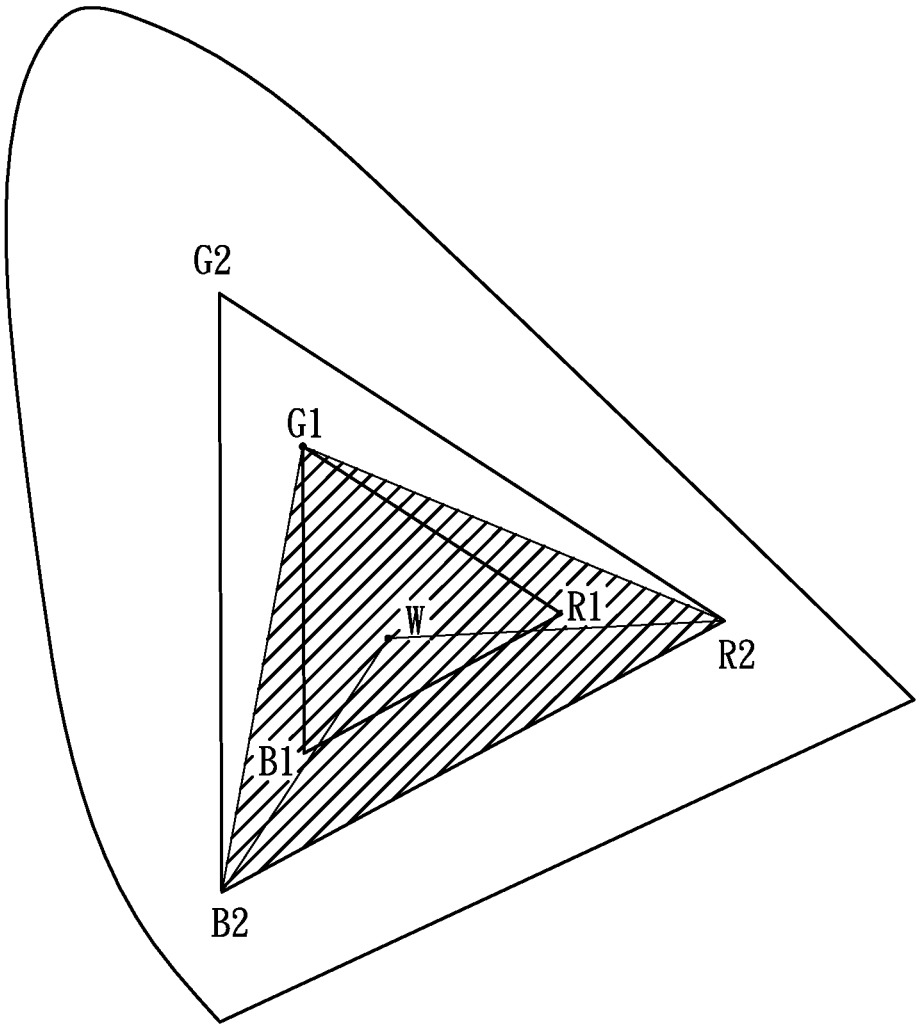
FIG. 10 is a schematic diagram showing a third gamut and a second gamut in CIE 1931 color chromaticity diagram according to one embodiment of the present disclosure when the display adopts a white light emission diode, a red light emission diode, a green light emission diode, and a blue light emission diode as the color light source thereof.

Referring to FIG. 9 and FIG. 10, FIG. 9 is a schematic diagram showing a first gamut and a second gamut in CIE 1931 color chromaticity diagram according to one embodiment of the present disclosure when the display adopts a white light emission diode, a red light emission diode, a green light emission diode, and a blue light emission diode as the color light source thereof, and FIG. 10 is a schematic diagram showing a third gamut and a second gamut in CIE 1931 color chromaticity diagram according to one embodiment of the present disclosure when the display adopts a white light emission diode, a red light emission diode, a green light emission diode, and a blue light emission diode as the color light source thereof. If the display has the red, green, blue color filters, the white light passes through the red, green, blue color filters to form the red, green, and blue lights which form the first gamut, wherein first gamut is defined by the color points R1, G1, B1. In addition, the red, green, and blue LEDs emit the red, green, and blue lights which form the second gamut, wherein second gamut is defined by the color points R2, G2, B2. The red and blue lights emitted by the red and blue LEDs and the color lights which the white light emitted by the white LED pass through the red, green, and blue filters form the third gamut, wherein third gamut is defined by the color points R2, G1, B2.

The embodiment of the present disclosure provides a display control method which can control the corresponding white and non-white light sources of the frame to be turned on/off or bright/dark according to the frame gamut of the frame. In other words, the display control method selects one of the first through third gamuts according to the hues of the pixels of the frame, and accordingly control the corresponding white and non-white light sources of the frame to be turned on/off, strong/weak, or bright/dark.

Figure 11:
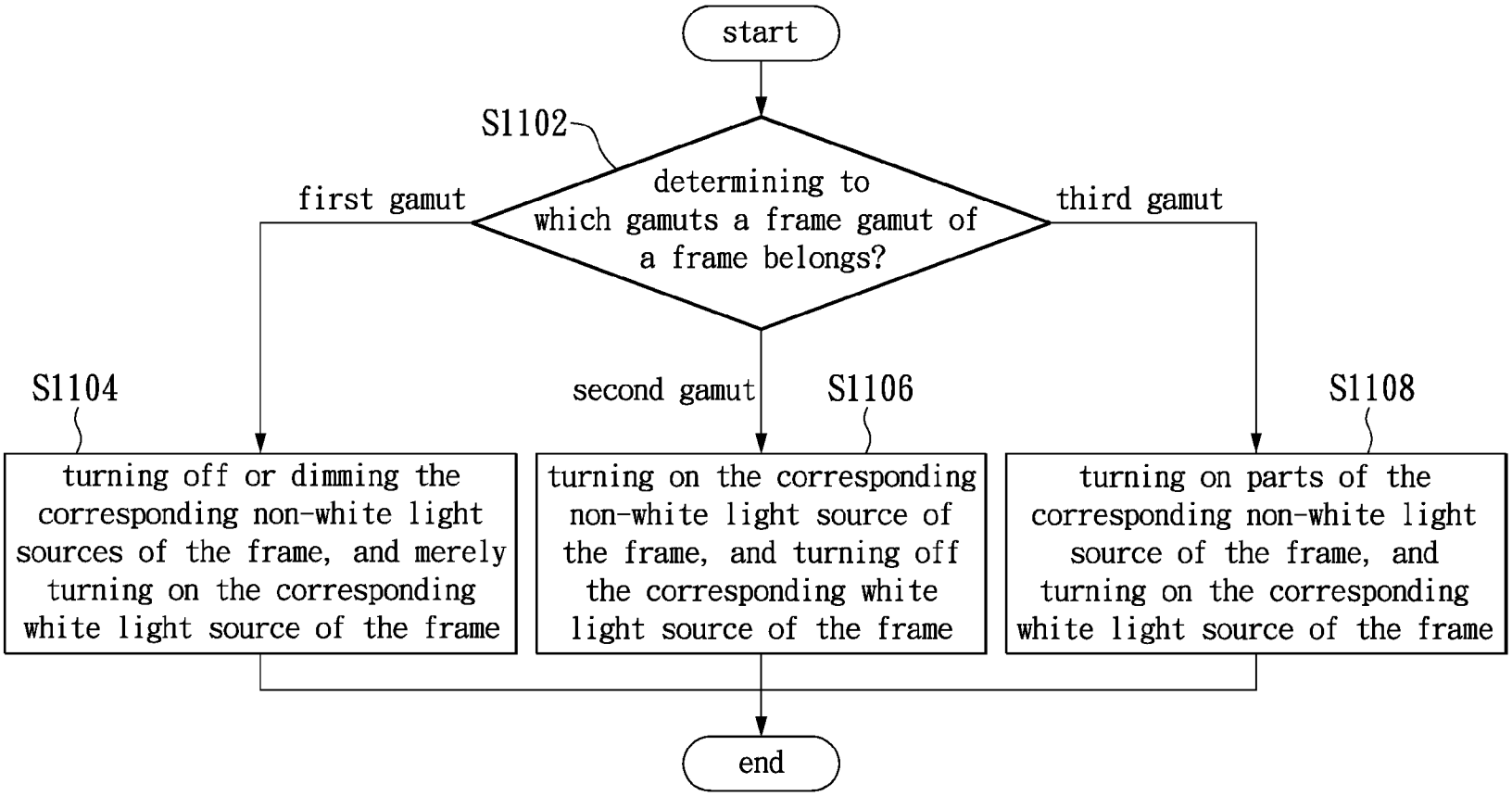
FIG. 11 is a flow chart of a display control method according to another embodiment of the present disclosure.

Referring to FIG. 1A and FIG. 11, FIG. 11 is a flow chart of a display control method according to another embodiment of the present disclosure. At step S1102, the processor 104 or the OS 102 process and calculates the video data of the frame to determine to which gamuts a frame gamut of a frame belongs, wherein the frame gamuts comprise the first through the third gamuts. The first gamut is a gamut formed by non-white lights which a white light emitted by the white light source passes through the non-white color filters, the second gamut is a gamut formed by non-white lights which non-white lights emitted by the non-white light sources pass through the non-white color filters, and the third gamut is a gamut formed by non-white lights which the non-white lights emitted by the partial non-white light sources and the white light emitted by the white light source pass through the non-white color filters.

Next, if the determination result shows the frame gamut is the first gamut, step S1104 is executed. If the determination result shows the frame gamut is the second gamut, step S1106 is executed. If the determination result shows the frame gamut is the third gamut, step S1108 is executed.

At step S1104, the timing controller 106 controls the light source driver 142 to generate the driving currents to the corresponding color light sources 144 of the frame in the light source module 14 according to the determination result, such that the corresponding non-white light sources of the frame are controlled to be turned off or dark, and the corresponding white light source of the frame is turned on. At step S1106 the timing controller 106 controls the light source driver 142 to generate the driving currents to the corresponding color light sources 144 of the frame in the light source module 14 according to the determination result, such that the corresponding non-white light sources of the frame are turned on, and the corresponding white light source of the frame is turned off. At step S1108, the timing controller 106 controls the light source driver 142 to generate the driving currents to the corresponding color light sources 144 of the frame in the light source module 14 according to the determination result, such that the color light sources of the corresponding partial non-white light sources of the frame are controlled to be turned on, and the corresponding white light source of the frame is turned on.

Referring to FIG. 9 through FIG. 11 simultaneously, for example, when the hues of the pixels of the frame in the display are mostly located within the first gamut (for example, the hues are the color point P3), the display merely uses the corresponding white LED of the frame, and the corresponding red, green, blue LEDs of the frame are turned off.

When the hue of the pixel of the frame exceeds the second gamut, the hue can be offset, wherein the offset hue is the color point on the second gamut which has the shortest distance to the hue, for example, the color point P2 is offset to be the color point P2'. When the hues of the pixels of the frame in the display are mostly located within the second gamut (or example, the hues are the color point P1 or P2'), the display turns off the corresponding white LED of the frame, and uses the corresponding red, green, blue LEDs of the frame. When the hues of the pixels of the frame in the display are mostly located within the third gamut (R2-G1-B2-R2), the display uses the corresponding white, red, blue LEDs of the frame, and the corresponding green LED of the frame is turned off.

It is noted that at least two of the display methods in FIG. 2, FIG. 4, FIG. 7, FIG. 8, and FIG. 11 can be combined to be executed in the display 1 according to the requirements or specification of the user or the display manufacturer. That is, the foregoing embodiments are not used to limit the present disclosure.

(Another Embodiment of Display Control Method)

The display control method in FIG. 11 controls and adjusts the corresponding color light sources of the frame according to the frame gamut of the entire frame, so as to dynamically switch the display gamut of the display. However, the present is not limited thereto. In the present disclosure, the display control method can control and adjust the corresponding color light sources of the sub-frame according to the frame gamut of the sub-frame.

Figure 12:
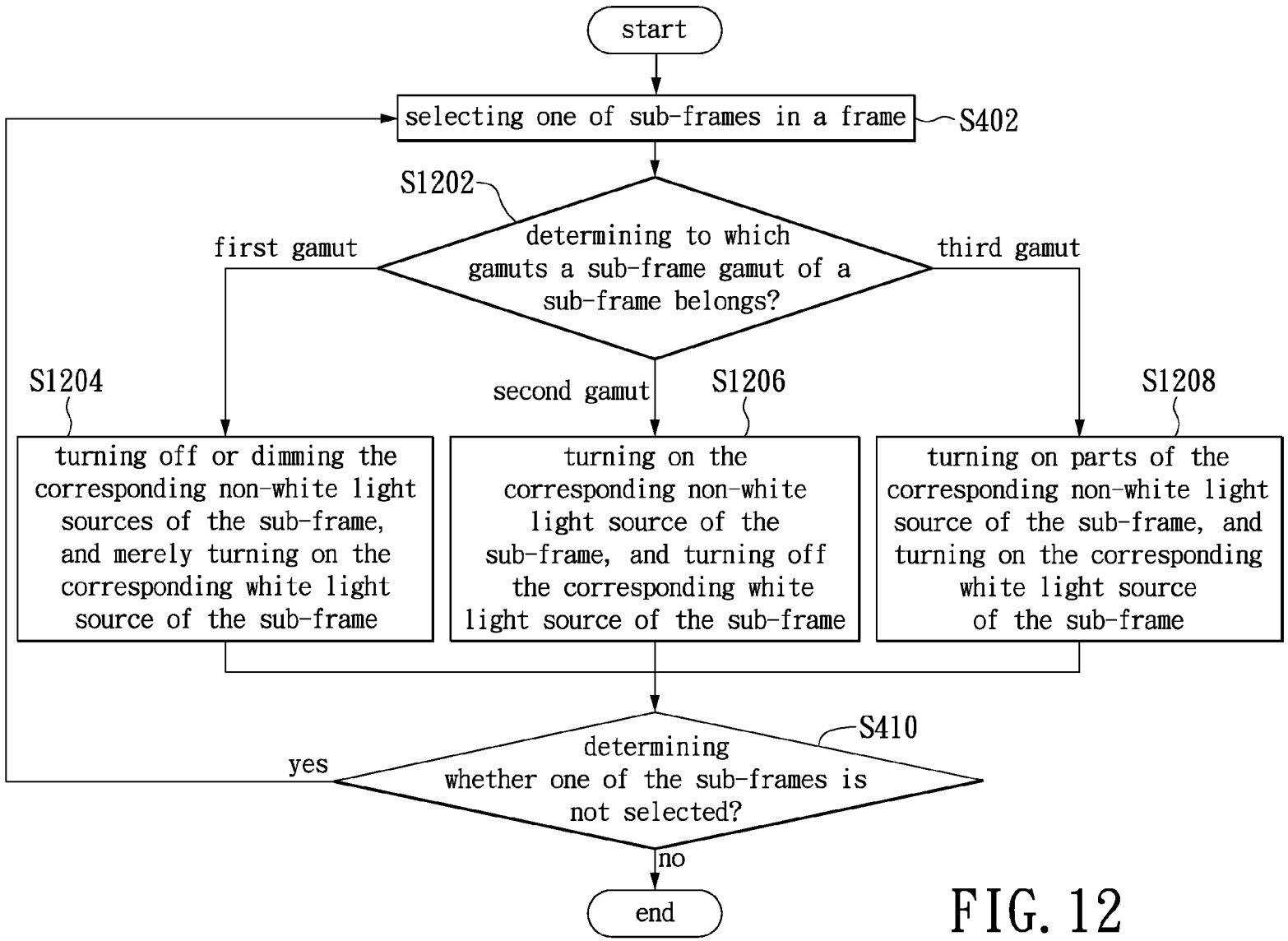
FIG. 12 is a flow chart of a display control method according to another embodiment of the present disclosure.

Referring to FIG. 1A and FIG. 12, FIG. 12 is a flow chart of a display control method according to another embodiment of the present disclosure. Steps S402 and S410 in FIG. 12 have been described, and thus the redundant description is omitted. At step S1202, the processor 104 or the OS102 process and calculates the video data of the sub-frame to determine to which gamuts a sub-frame gamut of a sub-frame belongs, wherein the sub-frame gamuts comprise the first through the third gamuts.

Next, if the determination result shows the sub-frame gamut is the first gamut, step S1204 is executed. If the determination result shows the sub-frame gamut is the second gamut, step S1206 is executed. If the determination result shows the sub-frame gamut is the third gamut, step S1208 is executed.

At step S1204, the timing controller 106 controls the light source driver 142 to generate the driving currents to the corresponding color light sources 144 of the sub-frame in the light source module 14 according to the determination result, such that the corresponding non-white light sources of the sub-frame are controlled to be turned off or dark, and the corresponding white light source of the sub-frame is turned on. At step S2106 the timing controller 106 controls the light source driver 142 to generate the driving currents to the corresponding color light sources 144 of the sub-frame in the light source module 14 according to the determination result, such that the corresponding non-white light sources of the sub-frame are turned on, and the corresponding white light source of the sub-frame is turned off. At step S1208, the timing controller 106 controls the light source driver 142 to generate the driving currents to the corresponding color light sources 144 of the sub-frame in the light source module 14 according to the determination result, such that the color light sources of the corresponding partial non-white light sources of the sub-frame are controlled to be turned on, and the corresponding white light source of the sub-frame is turned on.

It is noted that at least two of the display methods in FIG. 2, FIG. 4, FIG. 7, FIG. 8, FIG. 11, and FIG. 12 can be combined to be executed in the display 1 according to the requirements or specification of the user or the display manufacturer. That is, the foregoing embodiments are not used to limit the present disclosure.

(Possible Result of Embodiments)

In summary, the display, the display control method, and the display control system in the embodiments of the present disclosure can efficiently reduce at least of the color break phenomenon and power consumption. Thus, the display in the embodiment of the present disclosure give the user a better visual experience, and can meet the power saving trend.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A display control method, used in a display with color light sources, wherein the color light sources respectively provides color lights with colors, and the display control method comprises:

determining whether the frame relatively lacks at least one of the colors; and if the frame relatively lacks the at least one of the colors, executing at least one of steps of: (1) adjusting the corresponding color light source of the frame which color the frame relatively lacks to be weak, dark, or turned off, and (2) adjusting the corresponding color light source of the frame which color the frame does not relatively lack to be strong or bright;

wherein the frame comprises at least one sub-frame, and the display control method further comprises:

determining whether the sub-frame relatively lacks at least one of the colors; and if the sub-frame relatively lacks the at least one of the colors, executing at least one of the steps of: (1) adjusting the corresponding color light source of the sub-frame which color the sub-frame lacks to be weak, dark, or turned off, and (2) adjusting the corresponding color light source of the sub-frame which color the sub-frame does not lack to be strong or bright;

wherein the step of determining whether the sub-frame relatively lacks at least one of the colors further comprises:

executing at least one of steps of: (1) determining whether at least one of sub-frame gray levels of the colors associated with the sub-frame is less than a sub-frame gray level threshold, (2) determining whether at least one of sub-frame transmission rates of the colors associated with the sub-frame is less than a sub-frame transmission rate threshold, and (3) determining whether at least one of sub-frame darkness levels of the colors associated with the sub-frame achieves a sub-frame darkness threshold;

wherein the step of adjusting the corresponding color light source of the sub-frame which color the sub-frame lacks to be weak or dark further comprises:

executing at least one of steps of: (1) increasing the sub-frame gray level of the color less than the sub-frame gray level threshold, (2) increasing the sub-frame transmission rate of the color less than the sub-frame transmission rate threshold, and (3) increasing the sub-frame darkness level of the color achieving the sub-frame darkness threshold.

2. The display control method according to claim 1, wherein the corresponding color light sources of the frame and/or the sub-frame are independently controlled, and within a same frame-period, the corresponding color light sources of the frame and/or the sub-frame are controlled to be turned on/off or bright/dark, or the color lights emitted by the color light sources are adjusted to be strong/weak or bright/dark.

3. The display control method according to claim 1, wherein the corresponding color light sources of the frame and/or the sub-frame are independently controlled, and within sub frame-periods of a frame-period, the corresponding color light sources of the frame and/or the sub-frame are respectively controlled to be turned on/off or bright/dark, or the color lights emitted by the color light sources are respectively adjusted to be strong/weak or bright/dark.

4. The display control method according to claim 3, wherein respectively within the sub frame-periods, a driving current associated with the corresponding color light source of the color of the sub-frame is decreased gradually or step by step, so as to decrease an intensity or luminance of each the color light emitted by the corresponding color light source associated with the color of the sub-frame.

5. The display control method according to claim 1, wherein the color light sources comprise at least two of a red light source, a blue light source, a white light source, a green light source, a cyan light source, a purple light source, a chrysanthemum light source, and a yellow light source.

6. The display control method according to claim 1, further comprising:

when the display is a normal white display, executing at least one of steps of: (1) determining whether at least one of frame gray levels of the colors associated with the frame is less than a frame gray level threshold, (2) determining whether at least one of frame transmission rates of the colors associated with the frame is less than a frame transmission rate threshold, (3) determining whether at least one of frame darkness levels of the colors associated with the frame achieves a frame darkness threshold, and (4) determining whether at least one of frame driving voltages of the colors associated with the frame corresponding to the frame transmission rates of the colors associated with the frame is higher than a frame driving voltage threshold; and when the display is the normal white display, under at least one of conditions of: (1) the at least one of the frame gray levels of the colors associated with the frame is less than the frame gray level threshold, (2) the at least one of the frame transmission rates of the colors associated with the frame is less than the frame transmission rate threshold, (3) the at least one of the frame darkness levels of the colors associated with the frame achieves the frame darkness threshold, and (4) the at least one of the frame driving voltages of the colors associated with the frame corresponding to the frame transmission rates of the colors associated with the frame is higher than the frame driving voltage threshold, executing at least one of steps of: (1) increasing the frame gray level of the color less than the frame gray level threshold, (2) increasing the frame transmission rate of the color less than the frame transmission rate threshold, (3) increasing the frame darkness level of the color achieving the frame darkness threshold, and (4) decreasing the frame driving voltage of the color associated with the frame corresponding to the frame transmission rate of the color associated with the frame higher than the frame driving voltage threshold, and simultaneously executing at least one of another steps of: (1) adjusting the corresponding color light source of the color of the frame to be weak or dark accordingly, (2) decreasing a driving current associated with the corresponding color light source of the color of the frame accordingly, and (3) adjusting an on/off time or a bright/dark time associated with the corresponding color light source of the color of the frame accordingly.

7. The display control method according to claim 6, wherein within a frame-period, based on a display driving transformation reference table, according to an adjusting level of the frame gray level, the frame transmission rate, the frame darkness level, or the frame driving voltage of the color, the corresponding color light source of the color of the frame is adjusted to be weak or dark, the driving current associated with the corresponding color light source of the color of the frame is decreased, and/or the on/off time or a bright/dark time associated with the corresponding color light source of the color of the frame is adjusted.

8. The display control method according to claim 1, further comprising:

when the display is a normal white display, executing at least one of steps of: (1) determining whether at least one of sub-frame gray levels of the colors associated with the sub-frame is less than a sub-frame gray level threshold, (2) determining whether at least one of sub-frame transmission rates of the colors associated with the sub-frame is less than a sub-frame transmission rate threshold, (3) determining whether at least one of sub-frame darkness levels of the colors associated with the sub-frame achieves a sub-frame darkness threshold, and (4) determining whether at least one of sub-frame driving voltages of the colors associated with the sub-frame corresponding to the sub-frame transmission rates of the colors associated with the sub-frame is higher than a sub-frame driving voltage threshold; and when the display is the normal white display, under at least one of conditions of: (1) the at least one of the sub-frame gray levels of the colors associated with the sub-frame is less than the sub-frame gray level threshold, (2) the at least one of the sub-frame transmission rates of the colors associated with the sub-frame is less than the sub-frame transmission rate threshold, (3) the at least one of the sub-frame darkness levels of the colors associated with the sub-frame achieves the sub-frame darkness threshold, and (4) the at least one of the sub-frame driving voltages of the colors associated with the sub-frame corresponding to the sub-frame transmission rates of the colors associated with the sub-frame is higher than the sub-frame driving voltage threshold, executing at least one of steps of: (1) increasing the sub-frame gray level of the color less than the sub-frame gray level threshold, (2) increasing the sub-frame transmission rate of the color less than the sub-frame transmission rate threshold, (3) increasing the sub-frame darkness level of the color achieving the sub-frame darkness threshold, and (4) decreasing the sub-frame driving voltage of the color associated with the sub-frame corresponding to the sub-frame transmission rate of the color associated with the sub-frame higher than the sub-frame driving voltage threshold, and simultaneously executing at least one of another steps of: (1) adjusting the corresponding color light source of the color of the sub-frame to be weak or dark accordingly, (2) decreasing a driving current associated with the corresponding color light source of the color of the sub-frame accordingly, and (3) adjusting an on/off time or a bright/dark time associated with the corresponding color light source of the color of the sub-frame accordingly.

9. The display control method according to claim 1, further comprising:

when the display is a normal black display, executing at least one of steps of: (1) determining whether at least one of frame gray levels of the colors associated with the frame is less than a frame gray level threshold, (2) determining whether at least one of frame transmission rates of the colors associated with the frame is less than a frame transmission rate threshold, (3) determining whether at least one of frame darkness levels of the colors associated with the frame achieves a frame darkness threshold, and (4) determining whether at least one of frame driving voltages of the colors associated with the frame corresponding to the frame transmission rates of the colors associated with the frame is less than a frame driving voltage threshold; and when the display is the normal black display, under at least one of conditions of: (1) the at least one of the frame gray levels of the colors associated with the frame is less than the frame gray level threshold, (2) the at least one of the frame transmission rates of the colors associated with the frame is less than the frame transmission rate threshold, (3) the at least one of the frame darkness levels of the colors associated with the frame achieves the frame darkness threshold, and (4) the at least one of the frame driving voltages of the colors associated with the frame corresponding to the frame transmission rates of the colors associated with the frame is higher than the frame driving voltage threshold, executing at least one of steps of: (1) increasing the frame gray level of the color less than the frame gray level threshold, (2) increasing the frame transmission rate of the color less than the frame transmission rate threshold, (3) increasing the frame darkness level of the color achieving the frame darkness threshold, and (4) increasing the frame driving voltage of the color associated with the frame corresponding to the frame transmission rate of the color associated with the frame less than the frame driving voltage threshold, and simultaneously executing at least one of another steps of: (1) adjusting the corresponding color light source of the color of the frame to be weak or dark accordingly, (2) decreasing a driving current associated with the corresponding color light source of the color of the frame accordingly, and (3) adjusting an on/off time or a bright/dark time associated with the corresponding color light source of the color of the frame accordingly.

10. The display control method according to claim 1, further comprising:

when the display is a normal black display, executing at least one of steps of: (1) determining whether at least one of sub-frame gray levels of the colors associated with the sub-frame is less than a sub-frame gray level threshold, (2) determining whether at least one of sub-frame transmission rates of the colors associated with the sub-frame is less than a sub-frame transmission rate threshold, (3) determining whether at least one of sub-frame darkness levels of the colors associated with the sub-frame achieves a sub-frame darkness threshold, and (4) determining whether at least one of sub-frame driving voltages of the colors associated with the sub-frame corresponding to the sub-frame transmission rates of the colors associated with the sub-frame is less than a sub-frame driving voltage threshold; and when the display is the normal black display, under at least one of conditions of. (1) the at least one of the sub-frame gray levels of the colors associated with the sub-frame is less than the sub-frame gray level threshold, (2) the at least one of the sub-frame transmission rates of the colors associated with the sub-frame is less than the sub-frame transmission rate threshold, (3) the at least one of the sub-frame darkness levels of the colors associated with the sub-frame achieves the sub-frame darkness threshold, and (4) the at least one of the sub-frame driving voltages of the colors associated with the sub-frame corresponding to the sub-frame transmission rates of the colors associated with the sub-frame is higher than the sub-frame driving voltage threshold, executing at least one of steps of: (1) increasing the sub-frame gray level of the color less than the sub-frame gray level threshold, (2) increasing the sub-frame transmission rate of the color less than the sub-frame transmission rate threshold, (3) increasing the sub-frame darkness level of the color achieving the sub-frame darkness threshold, and (4) increasing the sub-frame driving voltage of the color associated with the sub-frame corresponding to the sub-frame transmission rate of the color associated with the sub-frame less than the sub-frame driving voltage threshold, and simultaneously executing at least one of another steps of: (1) adjusting the corresponding color light source of the color of the sub-frame to be weak or dark accordingly, (2) decreasing a driving current associated with the corresponding color light source of the color of the sub-frame accordingly, and (3) adjusting an on/off time or a bright/dark time associated with the corresponding color light source of the color of the sub-frame accordingly.

11. The display control method according to claim 1, wherein at least one of an operating system, a processor, and a display card is used to process and calculates a video data of the frame, so as to generate a determination result, and the determination result is used to control the corresponding color light sources to be turned on/off or bright/dark, to adjust the color lights emitted by the color light sources respectively to be strong/weak or bright/dark, or to adjust a corresponding gray level curve or a corresponding frame value of the frame.

12. The display control method according to claim 1, wherein the display is a thin-film transistor liquid crystal display, a transmission projection display, a reflection projection display, a reflection micro-display, or a display with color light emission diodes, color organic light emission diodes, or color electroluminescence devices.

13. The display control method according to claim 12, wherein the transmission projection display is a high temperature poly-silicon liquid crystal transmission projection display, a low temperature poly-silicon liquid crystal transmission projection display, or a liquid crystal on silicon transmission projection display, or the reflection projection display is a high temperature poly-silicon liquid crystal reflection projection display, a low temperature poly-silicon liquid crystal reflection projection display, or a liquid crystal on silicon reflection projection display.

14. The display control method according to claim 12, wherein the reflection projection display is a digital light processing reflection projection display, a liquid crystal on silicon reflection projection display, or a micro optic electro mechanics system reflection projection display.

15. The display control method according to claim 1, wherein the color light source is a color laser light source, a color light emission diode, a color electroluminescence device, a cold cathode fluorescent lamp, a mercury lamp with a color filter or a color wheel, or a helium lamp with the color filter or the color wheel.

16. The display control method according to claim 1, wherein within a frame-period, a driving current associated with the corresponding color light source of the color of the frame is decreased gradually or step by step, so as to decrease an intensity or luminance of the color light emitted by the corresponding color light source associated with the color of the frame.

17. The display control method according to claim 1, wherein the color light sources comprise a white light source and non-white light sources, each pixel of the display has non-white color filters, and the display control method further comprises: executing at least one of steps of: (1) controlling the corresponding white light source and the non-white light sources of the frame to be turned on/off or bright/dark according to a frame gamut of the frame, and (2) controlling the corresponding white light source and the non-white light sources of the sub-frame to be turned on/off or bright/dark according to a sub-frame gamut of the sub-frame.

18. The display control method according to claim 17, wherein when the frame gamut is a first gamut, the corresponding non-white light sources of the frame are controlled to be turned off or dark, and the corresponding white light source of the frame is turned on; when the frame gamut is a second gamut, the corresponding non-white light sources of the frame are turned on, and the corresponding white light source of the frame is turned off; when the sub-frame gamut is a first gamut, the corresponding non-white light sources of the sub-frame are controlled to be turned off or dark, and the corresponding white light source of the sub-frame is turned on; when the sub-frame gamut is a second gamut, the corresponding non-white light sources of the sub-frame are turned on, and the corresponding white light source of the sub-frame is turned off.

19. The display control method according to claim 18, wherein when the frame gamut is a third gamut, the color light sources of the corresponding partial non-white light sources of the frame are controlled to be turned on, and the corresponding white light source of the frame is turned on; when the sub-frame gamut is a third gamut, the color light sources of the corresponding partial non-white light sources of the sub-frame are controlled to be turned on, and the corresponding white light source of the sub-frame is turned on.

20. The display control method according to claim 19, wherein the first gamut is a gamut formed by non-white lights which a white light emitted by the white light source passes through the non-white color filters, the second gamut is a gamut formed by non-white lights which non-white lights emitted by the non-white light sources pass through the non-white color filters, and the third gamut is a gamut formed by non-white lights which the non-white lights emitted by the partial non-white light sources and the white light emitted by the white light source pass through the non-white color filters.

* * * * *